US006294305B1

(12) United States Patent
Kobayashi et al.

(10) Patent No.: US 6,294,305 B1
(45) **Date of Patent: *Sep. 25, 2001**

(54) IMAGE FORMING METHOD AND IMAGE FORMING APPARATUS

(75) Inventors: Yoshiaki Kobayashi, Numazu; Masaru Hibino, Minamiashigara; Masanori Shida, Shizuoka-ken; Ichiro Ozawa, Funabashi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 17 days.

(21) Appl. No.: 09/523,744

(22) Filed: Mar. 13, 2000

(30) Foreign Application Priority Data

Mar. 19, 1999 (JP) ..... 11-076457
May 18, 1999 (JP) ..... 11-137308

(51) Int. Cl.[7] ..... G03G 13/02; G03G 13/09; G03G 15/02; G03G 15/09

(52) U.S. Cl. ..... 430/122; 430/902; 361/225; 399/175; 399/270

(58) Field of Search ..... 430/122, 902; 361/225; 399/175, 270

(56) References Cited

U.S. PATENT DOCUMENTS 5,659,852 * 8/1997 Chigono et al. ..... 399/175
5,875,375 * 2/1999 Ohmori et al. ..... 430/902
5,994,019 11/1999 Okado et al. ..... 430/126
6,077,637 * 6/2000 Nishiguchi et al. ..... 430/122

FOREIGN PATENT DOCUMENTS 0 844 536 5/1998 (EP) .
61-57958 3/1986 (JP) .

* cited by examiner

*Primary Examiner*—Roland Martin
(74) *Attorney, Agent, or Firm*—Fitzpatrick, Cella, Harper & Scinto

(57) ABSTRACT

An image forming method includes (i) a charging step of using a charging device including conductive magnetic particles, a rotatable conductive-magnetic-particle carrying member for carrying and conveying the conductive magnetic particles, and a plurality of magnetic-field generation means provided within the conductive-magnetic-particle carrying member, and charging a surface of an image bearing member by applying a voltage to the conductive-magnetic-particle carrying member and causing the conductive magnetic particles to contact the image bearing member, (ii) a latent-image forming step of forming an electrostatic latent image on the charged surface of the image bearing member, and (iii) a developing step of using a developing device facing the image bearing member and including a two-component developer including a toner and magnetic carrier particles, a developer carrying member for carrying the two-component developer, and a plurality of magnetic-field generation means provided within the developer carrying member, and forming a toner image by forming an AC electric field at a portion where the image bearing member faces the developer carrying member and developing the electrostatic latent image by the toner of the two-component developer. An amount of frictional charging ($Q_1$) of the toner with the conductive magnetic particles and an amount of frictional charging ($Q_2$) of the toner with the magnetic carrier particles within the developing device satisfy the following relationship:

$$0<Q_2 \leqq Q_1 \text{ (mC/kg), or } 0>Q_2 \geqq Q_1 \text{ (mC/kg).}$$

72 Claims, 7 Drawing Sheets

IMAGE FORMING METHOD AND IMAGE FORMING APPARATUS

BACKGROUND OF THE INVENTION

1. Field of the Invention

The present invention relates to an image forming method used for a copier, a printer or a facsimile apparatus, and to an image forming apparatus. More particularly, the invention relates to an image forming method and an image forming apparatus using an electrophotographic method in which an image is obtained by developing an electrostatic latent image formed on an image bearing member using toner.

2. Description of the Related Art

Conventionally, an ordinary image forming method utilizing an electrophotographic method includes a charging process for charging an image bearing member, a latent-image forming process for forming an electrostatic latent image on the charged image bearing member, a developing process for forming a toner image by developing the electrostatic latent image, and a transfer process for transferring the toner image onto a transfer material.

However, in conventional image forming apparatuses utilizing the above-described image forming method, since a corona charger is used as a charging device for charging a photosensitive member, ozone is generated due to corona discharge during charging.

Recently, in accordance with increasing consciousness on environment, a contact charging method has been adopted as a charging method not using corona discharge which is accompanied with the generation of ozone. A magnetic-brush-type charging device, such as one described in Japanese Patent Laid-Open Application (Kokai) No. 61-57958 (1986), is preferably used as a charging member of the contact charging method from the viewpoint of stability in contact charging.

However, when image forming operations are repeated by using the above-described magnetic-brush-type contact charging device (magnetic-brush charger) and performing two-component (i.e., toner and magnetic carrier particles) contact development, fog is gradually produced in the formed image, and the dispersion of toner particles from the developing device increases.

The inventors of the present invention have performed various studies about the above-described phenomena of the generation of fog and the increasing dispersion of toner, and have determined that these phenomena occur due to gradual mixture of conductive magnetic particles for charging within the developing receptacle during the progress of image forming operations. The mechanism of the mixture of conductive magnetic particles for charging within the developing receptacle, and the reason of the generation of fog and the dispersion of toner particles will now be described.

In the magnetic brush charger, conductive magnetic particles for charging are carried on a charging sleeve incorporating a magnet by a magnetic force of constraint, to form a magnetic brush. By sliding of the magnetic brush in tight contact with the surface of the photosensitive member due to the rotation of the sleeve or the magnet, the surface of the photosensitive member is charged. In order to improve the charging property, the magnetic-brush-type contact charging device carries a considerably larger amount (at least twice) of magnetic particles than the amount of the developer carried on the developing sleeve of the two-component-type developing method. Accordingly, the distal end portion of the magnetic-particle layer on the charging sleeve is hardly magnetically constrained. Particularly when using a small-diameter sleeve (or magnet) and rotating the sleeve at a high speed, magnetic particles at the distal end of the magnetic-particle layer leave. The lost magnetic particles adhere onto the photosensitive member little by little, and are collected and accumulated into the developing receptacle at the developing portion in accordance with the rotation of the photosensitive member.

In image forming apparatuses in which a cleaning device is provided at a side upstream from the magnetic-brush charger in the direction of rotation of the photosensitive member, in some cases, toner particles and other additional agents pass between the cleaning blade of the cleaning device and the photosensitive member and are mixed, little by little, in the magnetic-brush charger in accordance with repeated image forming operations. As a result, the resistance of the magnetic brush increases, thereby causing a difference between the applied voltage and the potential on the surface of the photosensitive member, and adherence of magnetic particles onto the photosensitive member due to the potential difference.

In a system adopting a cleaner-less process in which a cleaning device is not provided at a side upstream from the magnetic-brush charger in the direction of rotation of the photosensitive member, a small amount of toner particles remaining on the photosensitive member after image transfer is first received in magnetic particles for charging of the magnetic-brush charger, the magnetic particles are discharged onto the photosensitive member after being stirred, and the toner particles discharged onto the photosensitive member are collected into the developing receptacle, since toner particles tend to be accumulated in the magnetic particles for charging, the above-described adherence of magnetic particles due to the potential difference tends to more easily occur.

The conductive magnetic particles for charging thus accumulated within the developing receptacle are mixed and stirred with toner particles within the developing receptacle and newly replenished toner particles. Conventionally, the relationship between the amount of charging of toner particles due to friction with the conductive magnetic particles for charging and the amount of charging of toner particles due to friction with magnetic carrier particles for development has not sufficiently been considered. For example, when the amount of charging of toner particles due to friction with the conductive magnetic particles for charging is less than the amount of charging of toner particles due to friction with the magnetic carrier particles for development, or the two types of toner particles have opposite polarities, the number of toner particles having smaller amounts of charging increases in the distribution of the amount of charging of toner particles within the developing receptacle. Furthermore, as the charging capability of magnetic carrier particles for development decreases after being used for a long time the number of toner particles having smaller amounts of charging increases, thereby increasing fog and dispersion of toner particles.

European Patent Laid-Open Application No. 0844536 (corresponding to U.S. Pat. No. 5,994,019) has proposed that by providing the relationship among the volume resistivity of the surface layer of a latent-image bearing member, the volume resistivity of a charging member of contact charging means, the volume resistivity of additional agents of toner, and the volume resistivity of a magnetic carrier of a two-component-type developer, the charging property by injection into the latent-image bearing member during charging is improved, an electrostatic latent image is not disturbed in a developing region during development, and an image having high picture quality and high durability can be formed.

However, even in the image forming method of the above-described prior art, in order to stably maintain the developing property even after a large number of repeated uses when using a small-diameter sleeve as a charging sleeve of a magnetic-brush charger, and forming an image while charging the surface of an image bearing member by rotating the sleeve at a high speed, it is necessary to perform further improvement.

SUMMARY OF THE INVENTION

It is an object of the present invention to provide an image forming method and an image forming apparatus in which the above-described problems are solved.

It is another object of the present invention to provide an image forming method in which fog in the obtained image and dispersion of toner do not increase even if image forming operations are repeated for a long time period using a small-diameter charging sleeve and charging the surface of an image bearing member by rotating the charging sleeve at a high speed.

According to one aspect of the present invention, an image forming method includes a charging step of using a charging device including conductive magnetic particles, a rotatable conductive-magnetic-particle carrying member for carrying and conveying the conductive magnetic particles, and a plurality of magnetic-field generation means provided within the conductive-magnetic-particle carrying member, and charging a surface of an image bearing member by applying a voltage to the conductive-magnetic-particle carrying member and causing the conductive magnetic particles to contact the image bearing member, a latent-image forming step of forming an electrostatic latent image on the charged surface of the image bearing member, and a developing step of using a developing device facing the image bearing member and including a two-component developer including a toner and magnetic carrier particles, a developer carrying member for carrying the two-component developer, and a plurality of magnetic-field generation means provided within the developer carrying member, and forming a toner image by forming an AC electric field at a portion where the image bearing member faces the developer carrying member and developing the electrostatic latent image by the toner of the two-component developer. An amount of frictional charging ($Q_1$) of the toner with the conductive magnetic particles and an amount of frictional charging ($Q_2$) of the toner with the magnetic carrier particles within the developing device satisfy the following relationship:

$$0<Q_2 \leqq Q_1 \text{ (mC/kg) or } 0>Q_2 \geqq Q_1 \text{ (mC/kg).}$$

According to another aspect of the present invention, an image forming apparatus includes a latent-image bearing member for bearing an electrostatic latent image, a charging device, including conductive magnetic particles, a rotatable conductive-magnetic-particle carrying member for carrying and conveying the conductive magnetic particles, and a plurality of magnetic-field generation means provided within the conductive-magnetic-particle carrying member, for charging the latent-image bearing member. The charging device charges a surface of the latent-image bearing member by applying a voltage to the conductive-magnetic-particle carrying member and causing the conductive magnetic particles to contact the latent-image bearing member. The apparatus also includes latent-image forming means for forming the electrostatic latent image on the charged surface of the latent-image bearing member, and a developing device facing the image bearing member and including a two-component developer including a toner and magnetic carrier particles, a developer carrying member for carrying the two-component developer, and a plurality of magnetic-field generation means provided within the developer carrying member, for forming a toner image by developing the electrostatic latent image. The developing device forms an AC electric field at a portion where the latent-image bearing member faces the developer carrying member and develops the electrostatic latent image by the toner of the two-component developer. An amount of frictional charging ($Q_1$) of the toner with the conductive magnetic particles and an amount of frictional charging ($Q_2$) of the toner with the magnetic carrier particles within the developing device satisfy the following relationship:

$$0<Q_2 \leqq Q_1 \text{ (mC/kg) or } 0>Q_2 \geqq Q_1 \text{ (mC/kg).}$$

The foregoing and other objects, advantages and features of the present invention will become more apparent from the following detailed description of the invention taken in conjunction with the accompanying drawings.

BRIEF DESCRIPTION OF THE DRAWINGS

FIG. 2A is a diagram illustrating the internal configuration of the developing device; and FIG. 2B is a diagram illustrating the internal configuration shown in FIG. 2B as seen from above;

DETAILED DESCRIPTION OF THE INVENTION

Figure 1:
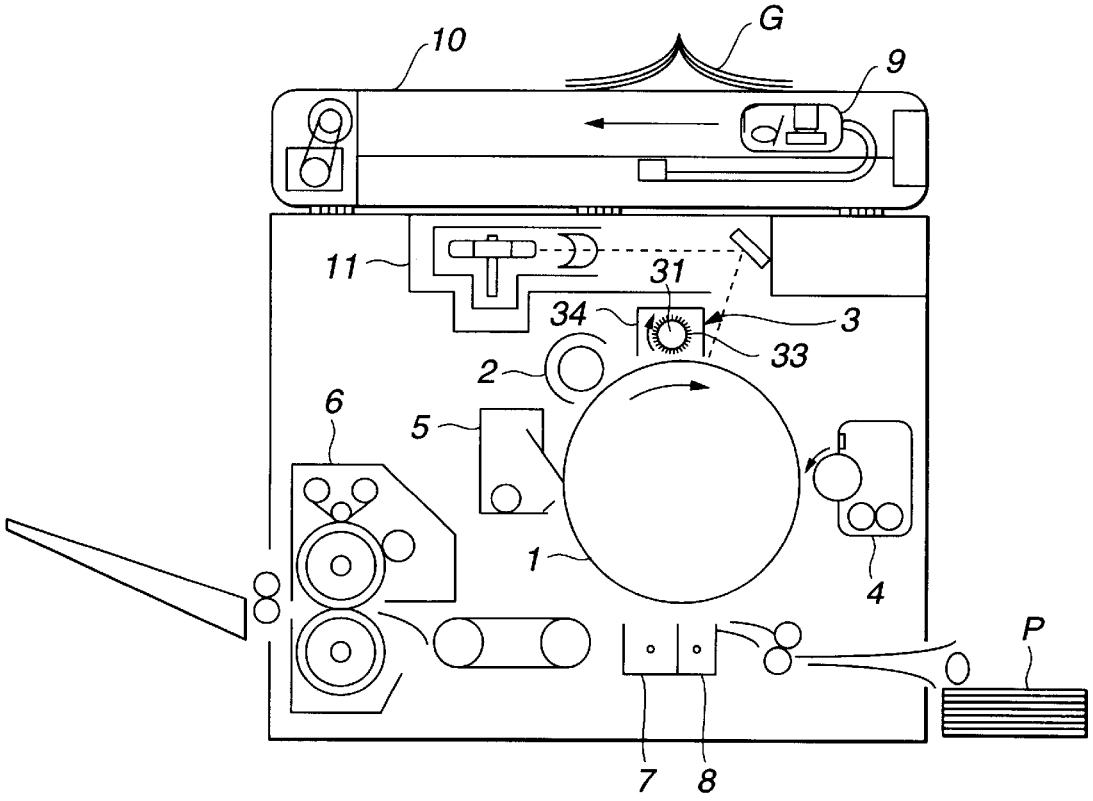
FIG. 1 is a schematic diagram illustrating the configuration of an image forming apparatus according to a first embodiment of the present invention.

The inventors of the present invention have performed studies on the above-described problems in the prior art and made the present invention by finding that, in an image forming method of using an image forming apparatus including a charging device using conductive magnetic particles as a contact charging member, a two-component-type developer including toner and magnetic carrier particles, and a developing device for visualizing an electrostatic latent image by developing it by forming an AC electric field at a portion facing an image bearing member, the above-described problems in the prior art are solved when, in order to prevent the occurrence of fog in the obtained image and dispersion of toner even after repeated image forming operations for a long time, the frictional-charging providing property of conductive magnetic particles for charging for toner and the frictional-charging providing property of magnetic carrier particles for the toner have a specific relationship, i.e., when the amount of charging ($Q_1$) of the toner with the conductive magnetic particles and the amount of charging ($Q_2$) of the toner with the magnetic carrier particles for developing have the following relationship:

$$0<Q_2 \leqq Q_1 \text{ (mC/kg) or } 0>Q_2 \geqq Q_1 \text{ (mC/kg).}$$

The reason why the above-described problems are solved will now be described.

As described above, in accordance with repeated image forming operations, conductive magnetic particles for charging are accumulated in the developing receptacle little by little. When, for example, using toner having a negative charging property, if the above-described three types of materials are selected so as to satisfy the relationship of $0>Q_2 \geqq Q_1$ for frictional charging, the toner has an amount of frictional charging by friction with the conductive magnetic particles for charging mixed within the developing receptacle equal to or more than an ordinary amount of charging by friction with the magnetic carrier particles for development, so that the distribution of amounts of charging of toner within the entire developing receptacle hardly changes from the distribution before the mixture. As a result, fog in the obtained image and dispersion of toner hardly occur.

It is preferable that the amount of frictional charging ($Q_1$) of the toner with the conductive magnetic particles for charging is equivalent to the amount of frictional charging ($Q_2$) of the toner with the magnetic carrier particles for development, because even if conductive magnetic particles for charging are mixed within the developing receptacle, the distribution of amounts of frictional charging of toner within the developing receptacle is not widened. Even when the absolute value of $Q_1$ is larger than the absolute value of $Q_2$, if the polarity of frictional charging of the entire magnetic carrier particles for development within the developing receptacle is not inverted due to the presence of a small amount of conductive magnetic particles for charging, the above-described effect can be effectively provided.

According to detailed studies by the inventors of the present invention, it is preferable that the amount of conductive magnetic particles for charging mixed within the developing receptacle is equal to or less than 20 weight % of the entire magnetic carrier particles for development within the developing receptacle, because the distribution amounts of charging the entire toner within the developing receptacle is not widened even if the absolute value of $Q_1$ is larger than the absolute value of $Q_2$. If the amount of conductive magnetic particles for charging exceeds 20 weight % of the amount of magnetic carrier particles for development, the ratio of inversion of polarity of carriers for development increases. As a result, the ratio of inversion of polarity of toner increases, and fog in the obtained image will easily occur.

It is also preferable that the amount of conductive magnetic particles for charging mixed in the developing receptacle is equal to or less than 20 weight % and the amounts of frictional charging of toner $Q_1$ and $Q_2$ have the relationship of $0<Q_2<Q_1$ (mC/kg) or $0>Q_2>Q_1$ (mC/kg), because even if the frictional-charging providing capability of the magnetic carrier particles for development for the toner decreases in accordance with repeated image forming operations by the magnetic carrier particles for development, the frictional-charging providing capability of the conductive magnetic particles for charging for the toner is high, so that it is possible to suppress a decrease in the average amount of charging of the toner and stably maintain the average amount of charging of the toner.

More preferably, the amounts of frictional charging of toner $Q_1$ and $Q_2$ have the above-described relationship, and also satisfy the following relationships:

$$5 \leqq |Q_1| \leqq 60 \text{ (mC/kg), and } 5 \leqq |Q_2| \leqq 60 \text{ (mC/kg).}$$

If $Q_1<Q_2$ when the relationship between the amounts of frictional charging $Q_1$ and $Q_2$ is $0<_1Q$, or if $Q_1>Q_2$ when $0>Q_1$, since the distribution of amounts of frictional charging of the toner within the developing receptacle is widened when conductive magnetic particles for charging of the magnetic-brush charger adhere to the surface of the photosensitive member and are mixed within the developing receptacle from the developing portion, fog in the obtained image and dispersion of tone will easily occur.

When the values of $|Q_1|$ and $|Q_2|$ are less than 5 mC/kg, since toner particles are easily separated from corresponding carrier particles, the dispersion of toner particles tends to occur. At the developing portion, since the number of toner particles whose polarity is inverted increases, reversal fog will also occur.

When the values of $|Q_1|$ and $|Q_2|$ exceed 60 mC/kg, toner particles adhere to corresponding carrier particles by a strong electrostatic force, the phenomenon that, when developing a black-letter portion, respective pairs of carrier particles and adhering toner particles develop the black-letter portion (adherence of carrier particles to the black-letter portion) occurs. In the developing unit, an increase in the charges of developing carrier particles causes an increase in the amount of adherence of carrier particles at a white-letter portion.

The image forming method of the present invention is realized, for example, in an image forming apparatus shown in FIG. 1.

FIG. 1 is a diagram illustrating an example of the configuration of an image forming apparatus according to a first embodiment of the present invention.

As shown in FIG. 1, the image forming apparatus includes an original-mount 10 where an original G is set, an original-scanning unit 9 for reading the image of the original G set on the original-mount 10 by moving along the original-mount 10, and converting the read image into an image signal, a photosensitive member 1 rotating around a central shaft at a predetermined circumferential speed and forming an image on its surface while rotating, a magnetic-brush charger 3 for charging the surface of the photosensitive member 1 to a uniform potential, exposure means 11 for forming an electrostatic latent image on the surface of the photosensitive member 1 by projecting a laser beam based on the image signal output from the original-scanning unit 9, a developing device 4, accommodating toner, for forming a toner image by developing the electrostatic latent image formed on the surface of the photosensitive member 1 using the toner, a transfer charger 7 for electrostatically transferring the toner image formed on the surface of the photosensitive member 1 onto a transfer material P, a separation charger 8 for electrostatically separating the transfer material P from the photosensitive member 1, a fixing unit 6 for fixing the toner image transferred onto the transfer material P on the transfer material P by heating, a cleaner 5 for removing adhering substances, such as toner particles, and the like, remaining on the photosensitive member 1 after passing through the transfer charger 7, and a charge remover 2 for removing a potential remaining on the surface of the photosensitive member 1 after passing through the transfer charger 7.

The original-scanning unit 9 includes an original-illuminating lamp for scanning the original G while projecting light onto the original G, a short-focus lens array for imaging light reflected from the original G of the light projected from the original-illuminating lamp and outputting an optical signal representing the reflected light, and a CCD (charge-coupled device) sensor for converting the optical signal output from the short-focus lens array into an image signal and outputting the image signal. These components are provided as one body.

The CCD sensor includes a light sensing portion for converting the optical signal output from the short-focus lens array provided within the original-scanning unit 9 into a charge signal and outputting the charge signal, a transfer portion for transferring the charge signal output from the light sensing portion in synchronization with clock pulses, and an output portion for converting the charge signal transferred from the transfer portion into a voltage signal, amplifying the voltage signal with a predetermined gain, and outputting the amplified signal in a state of a low impedance.

The operation of the image forming apparatus having the above-described configuration will now be described.

First, the original G is set on the original-mount 10 in a state in which a surface to be copied is placed downward. A copying operation is started by depressing a copy button (not shown).

Then, the original-scanning unit 9, integrally including the original-illuminating lamp, the short-focus lens array and the CCD sensor, scans the surface of the original G while projecting light. Light reflected from the original G of the illuminating light is incident upon the CCD sensor by being focused by the short-focus lens array.

Then, in the CCD sensor, the reflected light incident upon the light-sensing portion is converted into a charge signal, which is transferred to the output portion by the transfer portion in synchronization with clock pulses. In the output portion, the charge signal synchronized with the clock pulses is converted into an analog signal, which is amplified with a predetermined gain and is output in a state of low impedance.

The analog signal output from the original-scanning unit 9 is converted into a digital signal by being subjected to well-known image processing in image processing means (not shown), and the digital signal is input to the exposure means 11.

While the photosensitive member 1 performs one rotation, image formation is performed on the surface of the photosensitive member 1 based on the image signal converted into the digital signal by the image processing means.

First, charging (a charging process) is performed so that the surface potential of the photosensitive member 1 is uniformly about −650 V by a voltage applied from a power supply (not shown) to the charger 3.

Next, the photosensitive member 1 whose surface has been uniformly charged is scanned by a laser beam emitted from a solid laser device (not shown) subjected to on/off control based on the image signal input to the exposure means 11. The surface potential of a portion (an image portion) illuminated by the laser beam is attenuated to about −200 V, so that an electrostatic latent image based on the image signal is formed (a latent-image forming process).

Then, in the developing device 4, by applying a voltage obtained by superposing an AC voltage in the form of a rectangular wave having a value Vpp (peak-to-peak voltage) of 2,000 V, and a frequency of 2,000 Hz on a DC voltage of −500 V from a power supply (not shown) to a developing sleeve 21, a potential difference of about 300 V is produced between the surface potential of the image portion and the DC voltage applied to the developing sleeve 21.

The toner within the developing device 4 is charged to a negative (minus) polarity, and is conveyed onto the developing sleeve 21 and carried on the developing sleeve 21 by a magnetic force. The toner carried on the developing sleeve 21 electrostatically adheres onto the surface of the photosensitive member 1 due to a contrast potential, i.e., the above-described potential difference. The electrostatic latent image formed on the surface of the photosensitive member 1 is visualized by the toner to provide the toner image (a developing process).

The above-described developing method is particularly called a reversal developing method.

Then, the toner image formed on the surface of the photosensitive member 1 is electrostatically transferred onto the transfer material P at a time by receiving a predetermined electric field produced by a voltage applied from a power supply (not shown) to the transfer charger 7.

Then, the transfer material P electrostatically holding the toner image is separated from the photosensitive member 1 by the separation charger 8 and is conveyed to the fixing unit 6. In the fixing unit 6, the toner electrostatically held on the transfer material P is subjected to thermal fixing on the transfer material P by being heated. Thus, image formation for the transfer material P is terminated.

Toner particles remaining on the photosensitive member 1 without being transferred at a time by the transfer charger 7 at the image transfer are removed by the cleaner 5, and are collected as waste toner particles.

A potential corresponding to the electrostatic latent image remains on the surface of the photosensitive member 1 after passing through the transfer charger 7. The remaining potential is removed by the charge remover 2. Then, the photosensitive member 1 is again conveyed to the charging portion by the charger 3 in accordance with the rotation of the photosensitive member 1, in order to repeat image formation.

Figure 3:
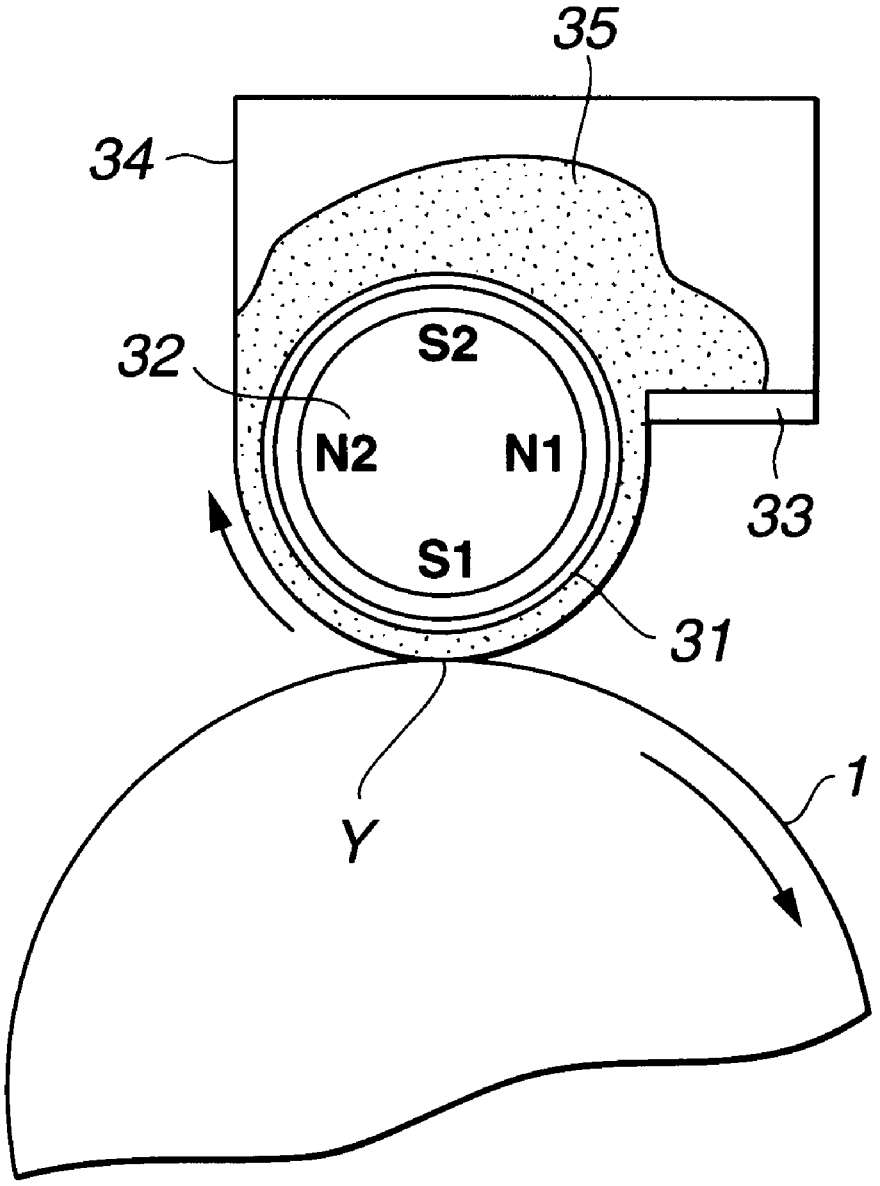
FIG. 3 is a schematic cross-sectional view illustrating a charging device used in the image forming apparatus shown in FIG. 1.
Figure 4:
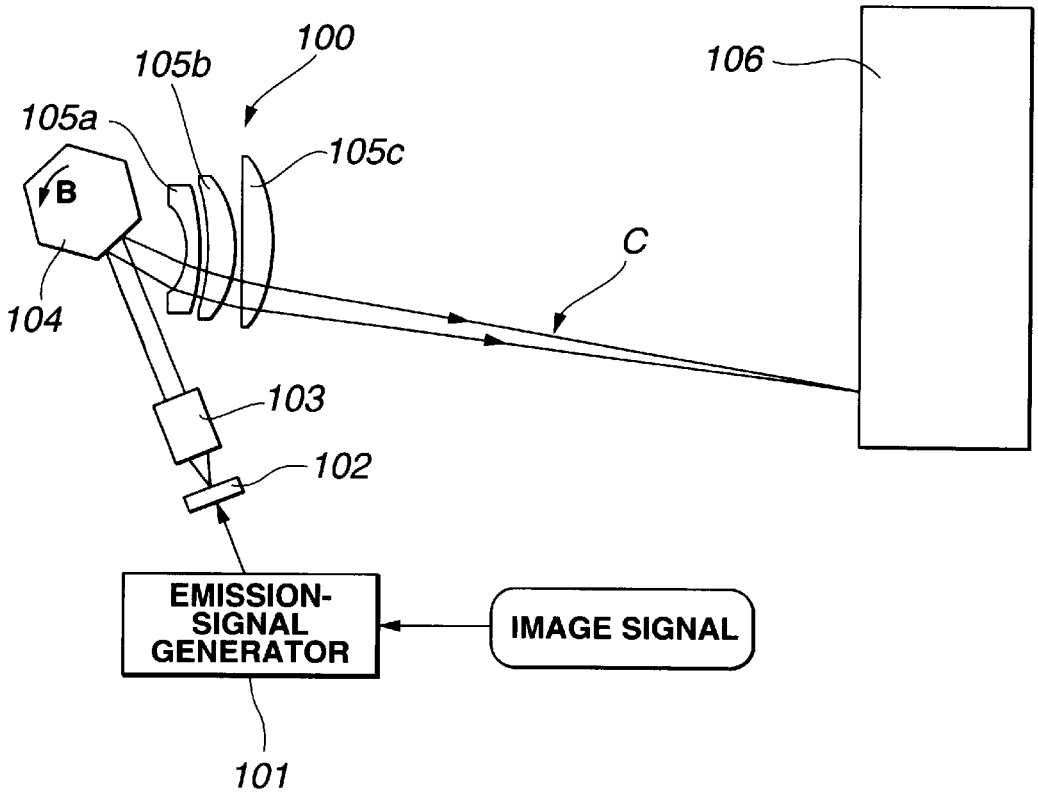
FIG. 4 is a schematic diagram illustrating the configuration of a laser scanning unit 100 for performing laser-beam scanning in the image forming apparatus shown in FIG. 1.

The charging process and the developing process in the above-described operation of the image forming apparatus will now be described in detail. FIG. 3 is a diagram illustrating an example of the configuration of the magnetic-brush charger 3 shown in FIG. 1.

As shown in FIG. 3, the magnetic-brush charger 3 includes a charging receptacle 34, having an opening at a portion near the photosensitive member 1, for accommodating conductive magnetic particles 35 for charging, a charging sleeve 31, incorporated in the opening provided in the charging receptacle 34 so as to be rotatable with a predetermined interval with the photosensitive member 1, and having a magnet 32 fixedly incorporated therein, for holding the conductive magnetic particles 35 on the surface thereof by the magnetic force of the magnet 32, to form a magnetic brush of the conductive magnetic particles for charging 35, and a blade 33, provided at a side downstream from a charging portion Y, where charging of the photosensitive member 1 is performed, in the direction of rotation of the charging sleeve 31 with a predetermined interval with the charging sleeve 31, for regulating the thickness of the layer of the conductive magnetic particles 35 carried on the surface of the charging sleeve 31.

The magnet 32 fixed within the charging sleeve 31 is provided at a position substantially facing the photosensitive member 1, and has a charging pole S1 for generating a magnetic field between the charging sleeve 31 and the photosensitive member 1, a magnetic pole N2 positioned at a side downstream from the charging pole S1 in the direction of rotation of the charging sleeve 31, and magnetic poles S2 and N1 for conveying the conductive magnetic particles 35. The magnetic brush of the conductive magnetic particles 35 is formed on the charging sleeve 31 by the magnetic field generated between the charging sleeve 31 and the photosensitive member 1 by the charging pole S1.

In the configuration shown in FIG. 3, the charging sleeve 31 has an outer diameter of 16 mm, is disposed so as to provide an interval of about 500 $\mu$m with the photosensitive member 1, and rotates in a direction opposite to the direction of rotation of the photosensitive member 1. The amount of the conductive magnetic particles 35 carried at the charging portion Y is adjusted to about 150 mg/cm$^2$ by the blade 33.

It is preferable that the outer diameter of the charging sleeve 31 is small from the viewpoint of reducing the size of the entire apparatus. The outer diameter of the charging blade 31 is preferably equal to or less than 25 mm, and more preferably within a range of 10–20 mm.

When using a charging sleeve having a small outer diameter as described above, in order to uniformly charge the surface of the photosensitive member by increasing the period of contact with the surface of the photosensitive member, it is necessary to rotate the charging sleeve at a high speed in a direction opposite to the moving direction of the surface of the photosensitive member (the counter direction). Uniform charging can be realized by rotating the charging sleeve, preferably at a speed within a range of 70–400 rpm, and more preferably at a speed within a range of 140–280 rpm.

When using a charging sleeve having a small diameter and charging the photosensitive member by rotating the charging sleeve at a high speed in the counter direction, conductive magnetic particles at the distal end of the magnetic brush held on the surface of the charging sleeve tend to leave and adhere onto the surface of the photosensitive member and to be collected and accumulated into the developing receptacle. In the present invention, however, by arranging the frictional-charging providing properties of the conductive magnetic particles for charging and the magnetic carrier particles for development so that the amounts of frictional charging of toner Q and Q have a specific relationship as described above, it is possible to effectively execute the image forming method including the charging process of performing charging by rotating a charging sleeve having a small diameter at a high speed.

The operation of the charger having the above-described configuration will now be described in detail.

The conductive magnetic particles 35 accommodated within the charging receptacle 34 are conveyed toward the charging portion Y in accordance with the rotation of the charging sleeve 31. In this conveying process, the thickness of the layer of the conductive magnetic particles 35 carried on the charging sleeve 31 is regulated by the blade 33.

A charging bias voltage obtained by superposing an AC sine-wave voltage on a DC voltage of −650 V is applied from a power supply (not shown) to the charging sleeve 31. The surface of the photosensitive member 1 is uniformly charged to about −650 V by this charging bias voltage.

It has been confirmed that by applying a charging bias voltage obtained by superposing an AC voltage on a DC voltage to the charging sleeve 31, the charging property is greatly improved and the life of the charger 3 is increased. As for optimum ranges for the values of the AC voltage, Vpp is preferably at least 500 V, more preferably at least 700 V, and still more preferably, within a range of 700–1,000 V, and the frequency is preferably within a range of 300–5,000 Hz, and more preferably within a range of 500–2,000 Hz.

When toner particles remaining on the surface of the photosensitive member 1 after image transfer reach the charging portion Y, the remaining toner particles are first collected into the charger 3 while being received in the conductive magnetic particles 35 carried on the charging sleeve 31, and the polarity of the remaining toner particles is returned to a negative polarity which is an ordinary charging polarity, by being stirred with the conductive magnetic particles 35. Then, the remaining toner particles are again discharged onto the photosensitive member 1 due to a potential difference between the DC voltage applied to the charging sleeve 31 and the surface potential of the photosensitive member 1.

The following three types of particles may be used as the conductive magnetic particles 35 to be used in the magnetic-brush charger.

(1) Magnetic particles obtained by mixing and kneading a resin and magnetic particles, such as magnetite particles, and then forming the mixture into particles, or magnetic particles obtained by mixing conductive carbon in the above-described mixture in order to adjust the resistance of the particles.

(2) Magnetic particles obtained from sintered magnetite, ferrite, or obtained by reducing or oxidizing such a material in order to adjust the resistance of the particles.

(3) Particles obtained by controlling the resistance of the above-described particles to an appropriate value by coating them with a coating material (for example, a material obtained by dispersing carbon in a phenol resin) having an adjusted resistance or plating them with a metal, such as Ni.

If the resistance of these magnetic particles are too high, charges cannot be uniformly injected into the photosensitive member, thereby generating fog in the obtained image due to a minute failure in charging. On the other hand, if the resistance of these magnetic particles are too low, current is concentrated in a pinhole in the photosensitive member if there is one, thereby reducing the charging voltage. As a result, the surface of the photosensitive member cannot be charged, thereby causing a failure in charging having the shape of a charging nip.

Accordingly, the volume resistance of the magnetic particles is preferably within a range of $1\times10^2$–$1\times10^{10}$ Ω, and more preferably within a range of $1\times10^6$–$1\times10^{10}$ Ω, in consideration of the presence of a pinhole, or the like, in the photosensitive drum. The volume resistance of the magnetic particles is measured by accommodating 2 g of magnetic particles in a metallic cell (having a base area of 228 mm$^2$) capable of being applied with a voltage, then loading them, and applying a voltage of 100 V.

As for the magnetic properties of the conductive magnetic particles for charging, the magnetic force of constraint is preferably high in order to prevent adherence of the particles onto the drum as much as possible. The saturation magnetization of the conductive magnetic particles is preferably at least 100 (emu/cm$^3$), and more preferably within a range of 150–300 (emu/cm$^3$).

The average diameter of the conductive magnetic particles is preferably within a range of 5–80 μm, and more preferably within a range of 10–60 μm.

If the average diameter is less than 5 μm, the problem that magnetic carriers where charges are injected during charging tend to adhere onto the photosensitive drum arises.

If the average volume diameter exceeds 80 μm, a failure in charging in a microscopic region tends to occur. Particularly in a cleaner-less system, this problem tends to explicitly arise when a certain amount of toner is accumulated within the charger at a later period of repeated image forming operations.

Next, the developing process will be described. A two-component-type contact developing method, in which a two-component-type developer, obtained by mixing toner particles and magnetic carrier particles, capable of easily obtaining a high-resolution and halftone image is used, and the image is developed in a state of contacting the photosensitive drum, is suitable as the developing method used in the image forming method of the invention, because a high-quality image in a full-color copier, or the like, can be formed.

Figure 2B:
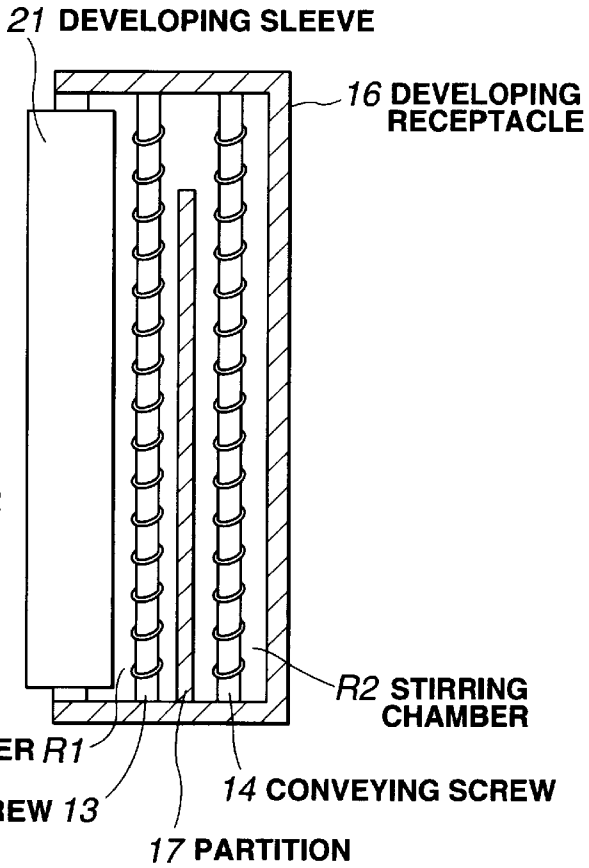
FIGS. 2A and 2B are schematic diagrams illustrating the configuration of a developing device used in the image forming apparatus shown in FIG. 1.
Figure 2A:
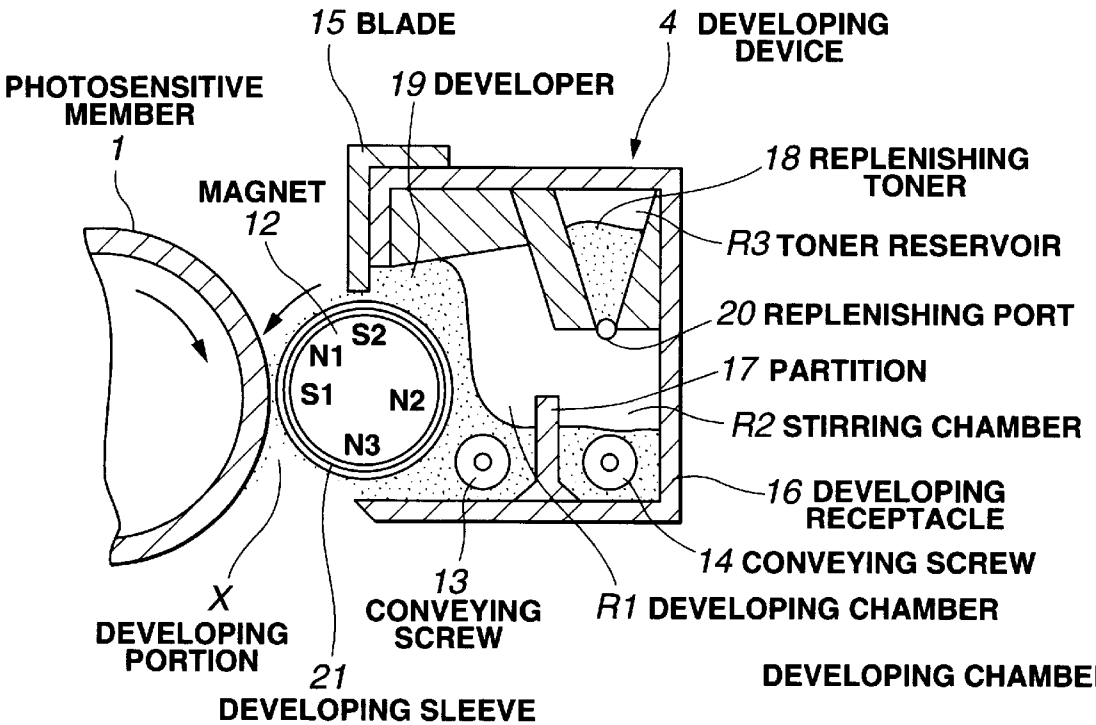

FIGS. 2A and 2B are diagrams illustrating an example of the configuration of the developing device 4 shown in FIG. 1: FIG. 1A is a diagram illustrating the internal configuration of the developing device 4; and FIG. 2B is a diagram illustrating the internal configuration of the developing device 4 shown in FIG. 2A, as seen from above.

In the developing device 4 shown in FIGS. 2A and 2B, a two-component-type developer obtained by mixing nonmagnetic toner particles and magnetic carrier particles for development is used as the developer, and development is performed according to the above-described two-component-type contact developing method.

As shown in FIG. 2A, the developing device 4 includes a developing receptacle 16, having an opening provided at a portion near the photosensitive member 1, for accommodating a developer 19, a developing sleeve 21, rotatably incorporated in the opening provided in the developing receptacle 16, and fixedly incorporating a magnet 12, for carrying the developer 19 on the surface thereof by a magnetic force of the magnet 12, and forming a magnetic brush of the developer 19, and a blade 15, provided above the developing sleeve 21 with a predetermined interval, for regulating the thickness of the layer of the developer 19 carried on the surface of the developing sleeve 21. During a developing operation, by applying a developing bias voltage from a power supply (not shown) to the developing sleeve 21, a potential difference is produced between the developing bias voltage applied to the developing sleeve 21 and the potential on the surface of the photosensitive member 1, and the toner on the developing sleeve 21 is moved to the photosensitive member 1 by the potential difference, to develop the latent image.

The developer 19 is a two-component-typed developer obtained by mixing toner particles with magnetic carrier particles for development with a weight ratio within a range of 4–10%, preferably within a range of 6–10%. The toner is nonmagnetic toner charged to a negative (minus) polarity. The toner has an average diameter within a range of 2–15 μm, preferably within a range of 5–15 μm. The magnetic carrier particles for development are ferrite particles whose surface is coated with a resin, or resin particles in which a magnetic material is dispersed, and have an average diameter within a range of 10–60 μm, preferably within a range of 25–60 μm, a volume resistivity within a range of $10^6$–$10^{12}$ Ω·cm, and a magnetic permeability within a range of 2.5–5.0.

The developing receptacle 16 includes a toner reservoir R3 for storing replenishing toner 18 and having a replenishing port 20 through which the replenishing toner 18 passes when freely falling, a developing chamber R1 having a conveying screw 13 in which an operation of conveying the developer 19 conveyed from a stirring chamber R2 in the longitudinal direction of the developing sleeve 21 and causing the developer 19 to be carried on the developing sleeve 21 is performed, and the stirring chamber R2 having a conveying screw 14 in which an operation of stirring the replenishing toner 18 freely fallen from the toner reservoir R3 and the developer 19 by the conveying screw 14 and conveying the replenishing toner 18 and the developer 19 in the longitudinal direction of the developing sleeve 21 is performed. The developing chamber R1 and the stirring chamber R2 are parted by a partition 17.

In the developing device shown in FIGS. 2A and 2B, the developing sleeve 21 is made of a nonmagnetic material, and has an outer diameter of 32 mm. The developing sleeve 21 is disposed at an interval of 500 μm with respect to the photosensitive member 1, and is rotatably driven in the moving direction of the surface of the photosensitive member 1 at a circumferential speed of 280 mm/sec.

The magnet 12 fixed within the developing sleeve 21 has a developing pole S1, provided at a position substantially facing the photosensitive member 1, for generating a magnetic field between the developing sleeve 21 and the photosensitive member 1, a magnetic pole N3 provided at a side downstream from the developing pole S1, and magnetic poles N2, S2 and N1 provided in order to convey the developer 19. A magnetic brush of the developer 19 is formed on the developing sleeve 21 by the magnetic field generated between the magnetic sleeve 21 and the photosensitive member 1 by developing pole S1.

The blade 15 is made of a nonmagnetic material, such as aluminum, SUS (stainless steel) 316, or the like, and is fixed to the developing receptacle 16 so as to provide an interval of 800 μm with the developing sleeve 21.

It is preferable that the outer diameter of the developing sleeve 21 is small from the view point of reducing the entire size of the apparatus. The outer diameter of the developing sleeve 21 is preferably equal to or less than 35 mm, and more preferably within a range of 10–25 mm.

The shortest interval between the surface of the developing sleeve 21 and the surface of the photosensitive member 1 is preferably within a range of 200–1,000 μm, and more preferably within a range of 300–800 μm. The shortest interval between the surface of the developing sleeve 21 and the distal end of the blade 15 is preferably within a range of 200–800 μm, and more preferably within a range of 200–500 μm.

The operation of the developing device 4 having the above-described configuration will now be described.

It is assumed that the surface of the photosensitive drum 1 is uniformly charged, for example, to a potential of about −650 V by the charger 3, and an electrostatic latent image whose image portion has, for example, a surface potential attenuated to a value of −200 V is formed by the exposure means 11 (see FIG. 1).

The developer 19 conveyed in the longitudinal direction of the developing sleeve 21 by the rotation of the conveying screw 13 within the developing chamber R1 is carried on the developing sleeve 21 at a position near the magnetic pole N2 of the magnet 12, and is conveyed in the direction of a developing portion X by the rotation of the developing sleeve 21.

Then, the thickness of the developer 19 carried on the developing sleeve 21 is regulated by the blade 15. Then, the magnetic particles for development constituting the developer 19 are raised in a state of being connected to one another from the developing sleeve 21 by the magnetic force of the magnetic pole S1 of the magnet 12, to form a magnetic brush of the developer 19 on the developing sleeve 21.

A developing bias voltage obtained by superposing an AC voltage on a DC voltage is applied from a power supply (not shown) to the developing sleeve 21. For example, a DC voltage of −500 V, and an AC voltage having the shape of a rectangular wave having a Vpp of 2,000 V and a frequency of 2,000 Hz are applied.

After uniformly charging the surface of the photosensitive member 1 to −650 V by the charger 3, a potential difference (contrast potential) of 300 V is produced between the surface potential of the image portion where the surface potential is attenuated to −200 V by being illuminated with the laser beam by the exposure means 11 and the DC voltage of −500 V applied to the developing sleeve 21. Since the developer 19 carried on the developing sleeve 21 has been stirred by the conveying screws 14 and 13 within the stirring chamber R2 and the developing chamber R1, respectively, the toner particles constituting the developer 19 are charged to a negative polarity due to friction with the magnetic particles for development. Accordingly, the toner carried on the developing sleeve 21 is moved to the image portion on the surface of the photosensitive member 1, to develop the latent image.

In general, when a developing bias voltage where an AC voltage is superposed is applied to the developing sleeve 21, although the efficiency of development is improved, and a high-quality image can be obtained, fog in the obtained image tends to occur. Usually, in order to solve such a problem, a countermeasure for preventing fog in the image by providing a potential difference (fog-removing potential) between the DC voltage applied to the developing sleeve 21 and the surface potential of a non-image portion of the photosensitive member 1 is executed. In the first embodiment, a fog-removing potential of 150 V which equals the potential difference between the surface potential of a non-image portion on the surface of the photosensitive member 1 of −650 V and the DC voltage applied to the developing sleeve 21 of −500 V is provided.

When the toner has been consumed by development of electrostatic latent images formed on the surface of the photosensitive member 1, the replenishing toner 18 accommodated in the toner reservoir R3 is supplied to the stirring chamber R2 by freely falling from the replenishing port 20 based on the consumed amount of the toner, is conveyed to the developing chamber R1 while being stirred with the developer 19 by the conveying screw 14 provided in the stirring chamber R2, is conveyed in the longitudinal direction of the developing sleeve 21 by the conveying screw 13 provided in the developing chamber R1, and is carried on the developing sleeve 21 at a position near the magnetic pole N2 of the magnet 12, in order to be used as toner for succeeding image forming operations.

In the above-described image forming method of the invention, it is preferable that the surfaces of the conductive magnetic particles for charging and the surfaces of the magnetic carrier particles for development are coated with the same material.

A case in which the surfaces of the conductive magnetic particles for charging and the surfaces of the magnetic carrier particles for development are coated with the same material will now be described in detail.

In a method for manufacturing conductive magnetic particles for charging and magnetic carrier particles for development, a core of each magnetic particle is formed according to (i) a method of polymerizing a binder resin, a magnetic metal oxide, such as magnetite, or the like, and nonmagnetic metal oxide, or (ii) a method of using sintered magnetite or ferrite, or adjusting the resistance of such a material by reducing or oxidizing it. Coating for providing a normal frictional charging property with toner is performed on the surface of the formed core. At that time, the surfaces of the conductive magnetic particles for charging and the magnetic carrier particles for development are coated with the same coating agent. The type of the coating agent to be used is not particularly limited, provided that a normal frictional charging property with toner used in the first embodiment is provided.

As described above, by using the same coating material for coating the surfaces of the conductive magnetic particles for charging and the magnetic carrier particles for development, the frictional charging property of toner within the developing receptacle with respect to the conductive magnetic particles for charging mixed within the developing receptacle is equivalent to the frictional charging property of the toner with respect to the magnetic carrier particles for development, even if the conductive magnetic particles for charging are accumulated within the developing receptacle little by little after repeating image forming operations. Hence, the distribution of amounts of charging of the toner within the developing receptacle hardly changes before and after the mixture of the conductive magnetic particles for charging, and it is possible to reduce the occurrence of fog in the obtained image and dispersion of toner.

Even if magnetic carrier particles for development are mixed within the charger, since the surfaces of the magnetic carrier particles for development and the surfaces of the conductive magnetic particles accommodated within the charger are coated with the same coating material, the physical properties of the two types of particles are substantially the same. Hence, the stirring property for toner particles remaining after image transfer hardly changes before and after the mixture of the magnetic carrier particles for development within the charger, so that the occurrence of dispersion of toner particles can be reduced.

It is preferable that the conductive magnetic particles for charging and the magnetic carrier particles for development have entirely the same physical properties. For example, when the volume resistivity is the same, even if magnetic carrier particles for development are mixed within the charger, the resistance does not substantially increase, so that it is possible to maintain the charging property. When the amount of magnetization is the same, even if magnetic carrier particles for development are mixed within the charger, it is possible to maintain the property of conveying the conductive magnetic particles for charging within the charger. Furthermore, even when conductive magnetic particles for charging are mixed within the developing receptacle, it is possible to maintain the property of conveying the developer within the developing receptacle, and to maintain excellent charging property and developing property.

When the average diameter is the same, even if magnetic carrier particles for development are mixed within the charger or conductive magnetic particles for charging are mixed within the developing receptacle, it is possible to suppress changes in the property of stirring the respective types of magnetic particles with toner within the charger or the developing receptacle, respectively.

An optimum range is present for each of the above-described physical properties in order to simultaneously maintain the charging property and the developing property excellently.

The volume resistivity of the magnetic carrier particles for development and the conductive magnetic particles for charging is preferably within a range of $1\times10^5$–$1\times10^{12}$ Ω·cm, and more preferably within a range of $1\times10^6$–$1\times10^9$ Ω·cm.

When the resistance of the conductive magnetic particles for charging is high, since charges cannot be uniformly injected into the photosensitive member, and the charging efficiency is reduced, fog in the obtained image due to a minute failure in charging is generated. When the resistance of the magnetic carrier particles for development is high, the effect as a facing electrode is degraded, and the macroscopic density of the obtained image decreases. On the other hand, when the resistance of the conductive magnetic particles for charging is low, if a pinhole is present on the surface of the photosensitive member, current is concentrated in the pinhole. As a result, the charging voltage is reduced and the surface of the photosensitive member cannot be charged, thereby causing a failure in charging in the shape of a charging nip. When the resistance of the magnetic carrier particles for development is low, charge injection occurs at a developing portion where the photosensitive member is developed, and the surface potential of the photosensitive member decreases by being converged to the voltage applied to the developing sleeve. As a result, a fog in the obtained image occurs or the density of the image decreases.

As for the magnetic properties of the conductive magnetic particles for charging, it is necessary to increase the magnetic force of constraint by increasing the amount of magnetization, in order to prevent adherence of magnetic particles to the photosensitive member. On the other hand, as for the magnetic properties of the magnetic carrier particles for development, if the amount of magnetization is too large, a defect in the obtained image tends to occur, because the ear of the magnetic brush formed by the magnetic carrier particles for development becomes coarse and hard.

Accordingly, as for the magnetic properties of the magnetic carrier particles for development and the conductive magnetic particles for charging, the amount of magnetization in a magnetic field of 1 kOe is preferably within a range of 50–350 emu/cm$^3$, and more preferably within a range of 70–300 emu/cm$^3$.

It is necessary to select the average diameter of the conductive magnetic particles for charging in consideration of the charging property, prevention of adherence to the photosensitive member, and the like, and to select the average diameter of the magnetic carrier particles for development in consideration of the developing property, the property of mixing and stirring with toner, prevention of adherence to the photosensitive member, and the like.

Accordingly, the average diameter of the magnetic carrier particles for development and the conductive magnetic particles for charging is preferably within a range of 5–80 μm, and more preferably within a range of 10–60 μm.

In the present invention, the average diameters of the magnetic carrier particles for development and the conductive magnetic particles for charging are measured using a combination of a laser-diffraction-type particle-size-distribution measuring apparatus HELOS (made by JEOL Ltd.) and a dry-type dispersion unit RODOS (made by JEOL Ltd.). Particle diameters within a range of 0.5–350.0 μm are measured by dividing the range into 31 channels as shown in the following table, under measuring conditions of a lens focal length of 200 mm, a dispersion pressure of 3.0 bar, and a measuring time within a range of 1–2 seconds. The particle diameter at 50% of the volume distribution (a median diameter) is made an average diameter.

| Range of particle diameters d (um) | | | |
|---|---|---|---|
| 0.5 ≦ d < 1.8 | 1.8 ≦ d < 2.2 | 2.2 ≦ d < 2.6 | 2.6 ≦ d < 3.0 |
| 3.0 ≦ d < 3.6 | 3.6 ≦ d < 4.4 | 4.4 ≦ d < 5.2 | 5.2 ≦ d < 6.2 |
| 6.2 ≦ d < 7.4 | 7.4 ≦ d < 8.6 | 8.6 ≦ d < 10.0 | 10.0 ≦ d < 12.0 |
| 12.0 ≦ d < 15.0 | 15.0 ≦ d < 18.0 | 18.0 ≦ d < 21.0 | 21.0 ≦ d < 25.0 |
| 25.0 ≦ d < 30.0 | 30.0 ≦ d < 36.0 | 36.0 ≦ d < 42.0 | 42.0 ≦ d < 50.0 |
| 50.0 ≦ d < 60.0 | 60.0 ≦ d < 72.0 | 72.0 ≦ d < 86.0 | 86.0 ≦ d < 102.0 |
| 102.0 ≦ d < 122.0 | 122.0 ≦ d < 146.0 | 146.0 ≦ d < 174.0 | 174.0 ≦ d < 206.0 |
| 206.0 ≦ d < 246.0 | 246.0 ≦ d < 294.0 | 294.0 ≦ d < 350.0 | |

The magnetic properties of the carrier used in the present invention are measured using a vibrating-magnetic-field-type magnetic-property automatic recording apparatus BHV-30 made by Riken Denshi Kabushiki Kaisha. An external magnetic field of 1 kOe is formed, and the intensity of magnetization of carrier particles at that time is measured. The carrier is sufficiently tightly packed in a plastic cylindrical receptacle. The magnetic moment of the carrier is measured in this state, and the intensity of magnetization (emu/g) is obtained by measuring the actual weight of the packed carrier. Then, the true specific gravity of the carrier particles is obtained by a dry-type automatic density meter Acupic 1330 (made by Shimadzu Corporation). By multiplying the intensity of magnetization (emu/g) by the true specific gravity, the intensity of magnetization per unit volume (emu/cm$^3$) in the present invention is obtained.

In the present invention, the amount of frictional charging $Q_1$ (mC/kg) of the toner with respect to the magnetic carrier particles for development and the amount of frictional charging $Q_2$ (mC/kg) of the toner with respect to the conductive magnetic particles for charging are measured in the following manner.

A measuring sample comprising 1 g of toner and 9 g of magnetic carrier particles for development or conductive magnetic particles for charging which has been left for one night in an environment of 23° C. and 50% RH is very precisely weighed in this environment, and the two components are sufficiently mixed (vertically shaken with hand about 125 times for about 50 seconds) in a polyethylene wide-mouthed bottle with a lid having a volume of about 50 c.c.

Figure 7:
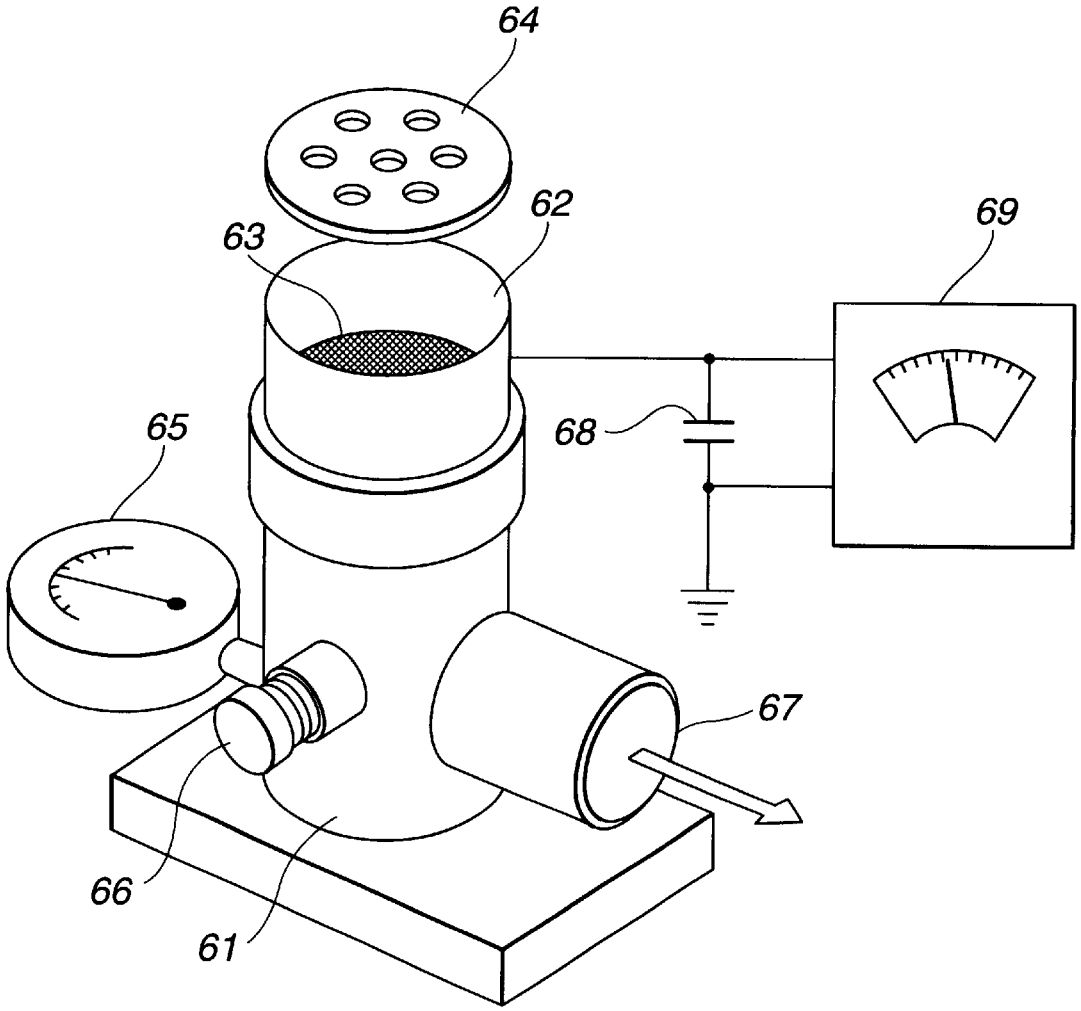
FIG. 7 is a diagram illustrating a measuring apparatus for measuring an amount of frictional charging of toner.

Then, about 2.0 g of the mixture is put in a metallic measuring receptacle 62 shown in FIG. 7 having a 400-mesh screen 63 at its bottom and is capped with a metallic lid 64. The entire measuring receptacle 62 at that time is weighed and the weight is represented by W1 (g). Then, the measuring receptacle 62 is subjected to suction from a suction port 67 by an aspirator 61 (made of an insulator at least at a portion contacting the measuring receptacle 62), so that the pressure measured by a vacuum gauge 65 becomes 250 mm Hg by adjusting a gas-quantity adjusting valve 66. The sample is subjected to suction removal by sufficiently performing suction in this state for 5 minutes. The potential measured by a potentiometer 69 at that time is represented by V (volts). A capacitor 68 has a capacitance of C (μF). The entire measuring receptacle 62 after suction is weighed, and the weight is represented by W2 (g). The amount of frictional charging (mC/kg) of this toner is calculated by the following equation:

The amount of frictional charging (mC/kg) of the toner=CV/(W1−W2).

Next, the photosensitive member, serving as the image bearing member, used in the invention will be described.

An organic photoconductor (OPC) photosensitive member, a Se photosensitive member, or an amorphous silicon (a-Si) photoconductive member may be used as the photosensitive member used in the contact charging method by the magnetic-brush charger according to the invention. In the present invention, since an injection charging method, which is most excellent from the viewpoint of ozone-less charging and low power consumption, is used from among contact charging methods using a magnetic brush, the photosensitive member preferably has a surface layer having a volume resistivity of $10^6$–$10^{12}$ Ω·cm. Particularly, a photosensitive member manufactured according to the following manufacturing method is preferably used.

Figure 5:
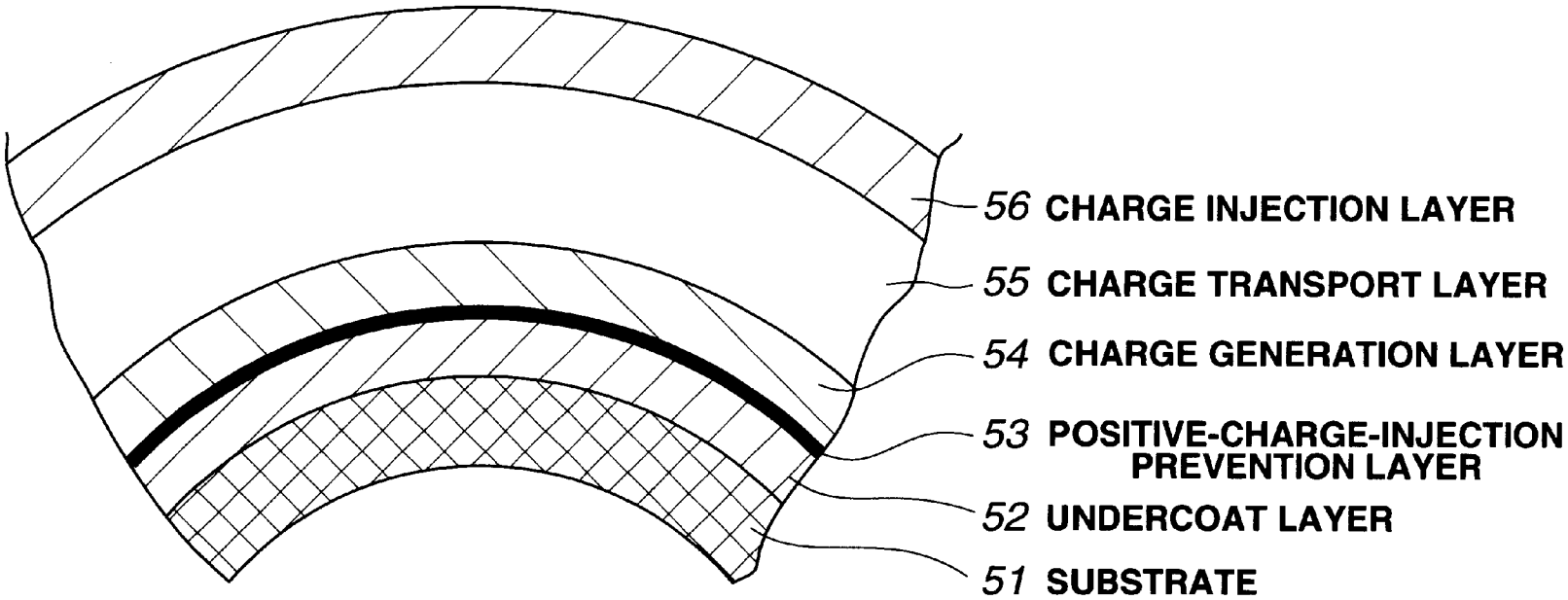
FIG. 5 is a diagram illustrating an example of the configuration of a photosensitive member used in the image forming apparatus shown in FIG. 1.

FIG. 5 is a diagram illustrating an example of the configuration of the photosensitive member 1 shown in FIG. 1.

As shown in FIG. 5, the photosensitive member 1 includes a substrate 51 made of aluminum having a diameter of 30 mm, an undercoat layer 52, provided on the substrate 51, for preventing the generation of moire pattern due to reflection of a laser beam in the exposure process, a positive-charge-injection prevention layer 53, provided on the undercoat layer 52, for preventing cancel of negative charges on the surface of the photosensitive member 1 by positive charges injected from the substrate 51, a charge generation layer 54, provided on the positive-charge-injection prevention layer 53, for generating respective pairs of positive and negative charges by exposure, a charge transport layer 55, provided on the charge generation layer 54, for transporting charges generated by the charge generation layer 54, and a charge injection layer 56, provided on the charge transport layer 55, for injecting charges.

The undercoat layer 52 is a conductive layer 20 μm thick. The positive-charge-injection prevention layer 53 is a medium-resistance layer about 0.1 μm thick whose volume resistivity is adjusted to about $1\times10^6$ Ω·cm by an amylane resin and methoxymethylated nylon. The charge generation layer 54 is a layer about 0.3 μm thick obtained by dispersing a dis-azo-type pigment in a resin. The charge transport layer 55 is made of a p-type semiconductor obtained by dispersing hydrazone in a polyearbonate resin. The charge injection layer 56 is a layer about 2 μm thick whose volume resistivity is adjusted to $1\times10^{13}$ Ω·cm by dispersing low-resistance particles of $SnO_2$, or the like, in a polycarbonate resin.

The volume resistivity of the charge injection layer 56 is preferably within a range of $1\times10^9$–$1\times10^{14}$ Ω·cm. By adjusting the volume resistivity within this range, the charging property is improved, and a higher-quality image can be obtained.

The charge transport layer 55 has an insulating property of at least $10^{16}$ Ω·cm, converted into the volume resistivity, with respect to negative charges supplied to the photosensitive member during the charging process. Accordingly, the charge transport layer 55 differs from the charge injection layer 56 in the electric properties. The volume resistivity of the charge injection layer 56 and the volume resistivity of the charge transport layer 55 have the following relationship:

the volume resistivity of the charge injection layer 56> the volume resistivity of the charge transport layer 55.

The volume resistivity of each layer of the photosensitive member used in the first embodiment is measured by disposing metallic electrodes with a distance of 200 μm, forming each layer by pouring a compositional liquid for the layer between the electrodes, and applying a voltage of 100 V between the electrodes under the conditions of a temperature of 23° C. and a humidity of 50% RH.

An amorphous silicon photosensitive member may be used instead of the above-described OPC photosensitive member. The use of an amorphous silicon photosensitive member has a feature of realizing a longer life of the photosensitive member after repeated image forming operations.

In the present invention, by using the above-described injection charging method, it is also possible to realize a cleaner-less system (simultaneous cleaning with development). In the cleaner-less system, cleaning means for collecting remaining toner particles in a state of contacting the surface of the photosensitive member between the transfer portion and the charging portion in the moving direction of the photosensitive member is not provided, and development of the succeeding electrostatic latent image formed on the photosensitive member is simultaneously performed while collecting the toner particles remaining on the surface of the photosensitive member after image transfer by a developing unit. The cleaner-less system does not require conventional cleaning means and does not produce waste toner particles, and is therefore an excellent system from the viewpoint of environment protection and reduction of the size of the image forming apparatus.

A mechanism of collecting toner particles remaining after image transfer by a developing unit will now be described.

Figure 6:
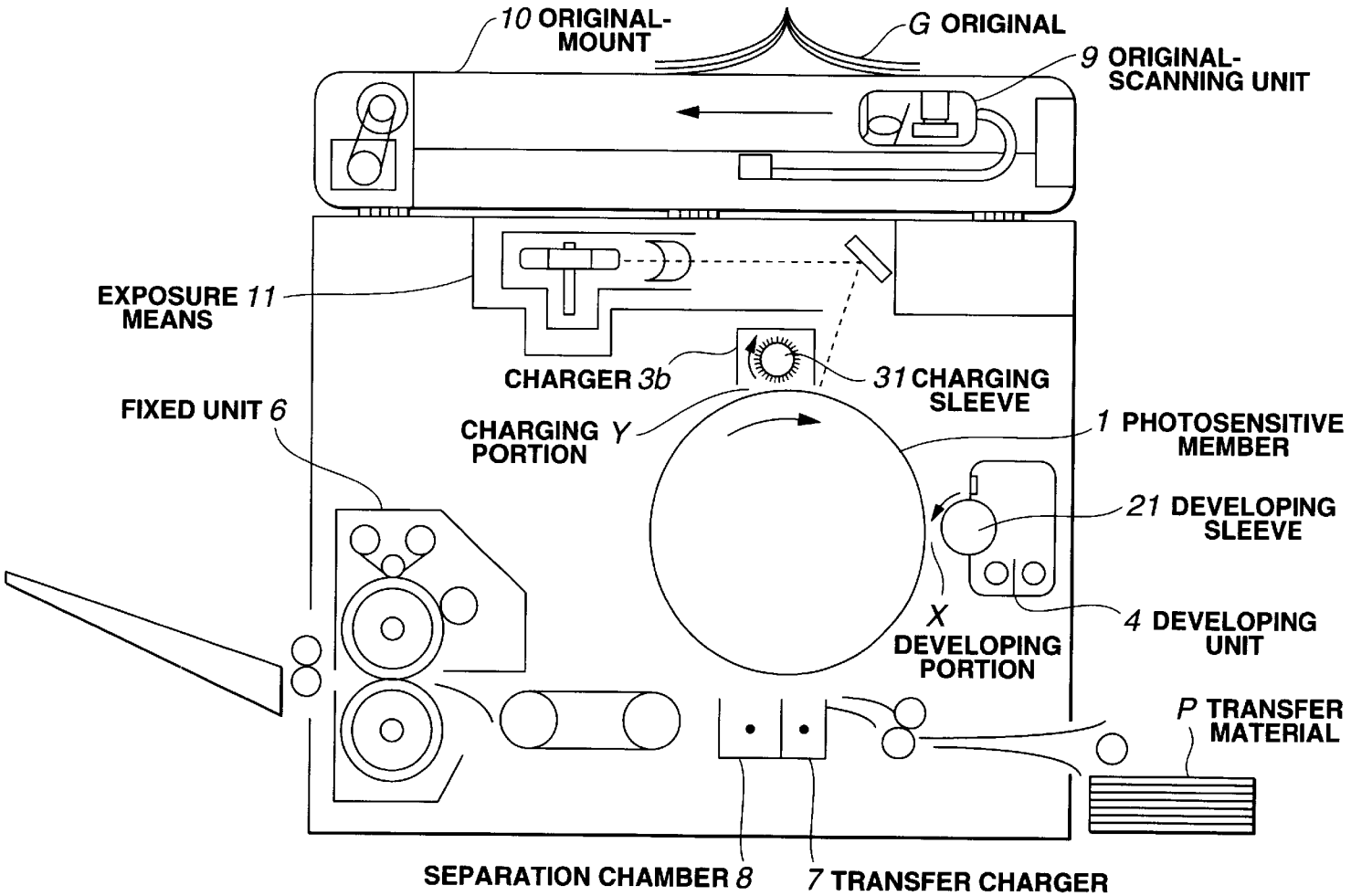
FIG. 6 is a schematic diagram illustrating the configuration of an image forming apparatus, in which remaining toner particles after image transfer are collected by a developing unit, according to a second embodiment of the present invention.

FIG. 6 is a diagram illustrating the mechanism of collecting toner particles remaining after image transfer by a developing unit.

In FIG. 6, the charge remover 2 and the cleaner 5 are removed from the image forming apparatus shown in FIG. 1.

It is assumed that the surface of a photosensitive member 1 is uniformly charged to a potential of about −650 V, and an electrostatic latent image is formed in a state in which the surface potential of an image portion is attenuated to about −200 V by exposure means 11.

A developing unit 4 adopts a two-component-type contact developing method. It is assumed that a developing bias voltage obtained by superposing an AC voltage having a rectangular wave form having Vpp of 2,000 V and a frequency of 2,000 Hz on a DC voltage of −500 V is applied from a power supply (not shown) to the developing unit 4, and development is performed according to the above-described reversal developing method.

First, by collecting toner particles remaining after image transfer into a charger 3 at a charging portion Y between the charger 3 and the photosensitive member 1, and stirring the collected particles with conductive magnetic particles for charging constituting the charger 3, the charging polarity of the toner particles remaining after image transfer is returned to a state of a normal charging polarity (a negative polarity). Then, by utilizing the potential difference between the voltage applied to a charging sleeve 31 and the surface potential of the photosensitive member 1, the toner particles remaining after image transfer returned to the normal charging polarity are discharged onto the photosensitive member 1.

By forming an electrostatic latent image on the surface of the photosensitive member 1 by the exposure means 11 in the succeeding process, the toner particles remaining after image transfer discharged on the photosensitive member 1 are separately supplied to an image portion and a non-image portion on the photosensitive member 1. The non-image portion is a portion uniformly charged by the charger 3 to a surface potential of about −650 V, and the image portion is a portion whose surface potential is attenuated to about −200 V by being illuminated by the laser beam from the exposure means 11 after being uniformly charged to about −650 V by the charger 3.

When the photosensitive member 1 reaches a developing portion X in the above-described state in which the toner particles remaining after image transfer are present at the non-image portion and the image portion, the toner particles remaining after image transfer which are present on the image portion remain on the photosensitive member 1, and are transferred by a transfer charger 7, to contribute to the subsequent image. On the other hand, the toner particles remaining after image transfer which are present on the non-image portion are electrostatically collected into the developing unit 4 due to a fog removing potential of 150 V which equals the difference between the DC voltage of −500 V applied to a developing sleeve 21 and the surface potential of −650 V of the photosensitive member 1.

At that time, in the developing unit 4, an operation of developing the electrostatic latent image for the next image is performed simultaneously with the above-described operation of collecting the toner particles remaining after image transfer.

In order to assuredly perform the operation of collecting the toner particles remaining after image transfer, the charging polarity of the toner particles remaining after image transfer at the developing portion X (a collecting portion) must be the same as the charging polarity of the toner within the developing unit 4. In the present invention, in the charger 3, an operation of returning the charging polarity of toner particles remaining after image transfer charged to a polarity opposite to the charging polarity of the toner within the developing unit 4 to the same polarity as the toner within the developing unit 4, in order to adjust the charging polarity of the toner particles remaining after image transfer to a normal charging polarity is performed.

According to the above-described configuration, since the toner particles remaining after image transfer which have reached the developing portion X substantially have a negative polarity which is a normal charging polarity and are excellently collected by the developing unit 4, a cleaner-less system in which simultaneous developing and cleaning operations are realized can be achieved.

According to the present invention, even if image forming operations are repeated for a long time by using a small-diameter charging sleeve as a charging sleeve of a magnetic-brush charger in the charging process and performing charging by rotating the charging sleeve at a high speed, it is possible to provide an excellent image in which the generation of fog and the dispersion of toner do not occur.

Next, the present invention will be more specifically described illustrating examples and comparative examples.

EXAMPLE 1

Image formation was performed under the following charging conditions, developing conditions, and charging series using the photosensitive member having the charge injection layer shown in FIG. 5, the magnetic-brush charger shown in FIG. 3, and the developing device according to the two-component-type contact developing method shown in FIGS. 2A and 2B in the image forming apparatus shown in FIG. 1, and fog and the dispersion of toner on a transfer sheet were evaluated.

Charging Conditions:

- the materials of conductive magnetic particles - - - core; ferrite, coating material; a silicone-type resin
- the volume resistivity of the conductive magnetic particles - - - $1\times10^6$ Ω·cm
- the volume average diameter of the conductive magnetic particles - - - 30 μm
- the saturation magnetization of the conductive magnetic particles - - - 200 emu/cm$^3$ (in a magnetic field of 1 kOe)
- the outer diameter of the charging sleeve - - - 16 mm
- the rotational speed of the charging sleeve - - - 168 rpm (in a direction opposite to the moving direction of the surface of the photosensitive member)
- the magnetic poles of the magnet within the charging sleeve - - - 4 poles shown in FIG. 3
- the DC component of the charging bias voltage - - - −650 V
- the AC component of the charging bias voltage - - - 700 Vpp, 1,000 Hz
- the surface potential of the charged photosensitive member - - - −650 V Developing Conditions: developer - - - a two-component-type developer (a toner density of 6 weight %) including a nonmagnetic toner having a negative charging property including a polyester resin as a main component and a coloring agent and a negative-charge controlling agent, and resin-coated ferrite carrier particles obtained by coating the surfaces of ferrite-carrier cores with a silicone resin

- the volume resistivity of the magnetic carrier particles - - - $5\times10^6$ Ω·cm
- the average diameter of the magnetic carrier particles - - - 35 μm
- the saturation magnetization of the magnetic carrier particles - - - 140 emu/cm$^3$ (in a magnetic field of 1 kOe)
- the outer diameter of the developing sleeve - - - 16 mm
- the rotation speed of the developing sleeve - - - 210 rpm (in the moving direction of the surface of the photosensitive member)
- the magnetic poles of the magnet within the developing sleeve - - - 5 poles shown in FIG. 2A
- the DC component of the developing bias voltage - - - −500 V
- * the AC component of the developing bias voltage - - - 2,000 Vpp, 2,000 Hz
- the light-portion potential - - - −200 V
- the shortest interval between the surface of the developing sleeve and the surface of the photosensitive member - - - 500 μm
- the shortest interval between the surface of the the developing sleeve and the surface of the blade - - - 800 μm Charging series (the amount of frictional charging of toner): All of the conductive magnetic particles, the magnetic carrier particles and toner were initial materials. Measurement was performed under an environment of 23° C./50% RH according to a two-component blow-off method.

- the amount of frictional charging of the toner with respect to the conductive magnetic particles for charging - - - −22 mC/kg
- the amount of frictional charging of the toner with respect to the carrier particles for development - - - −22 mC/kg Image formation was performed under the above-described conditions. Even after repeating image forming operations for 50,000 sheets, an excellent image was obtained in which no fog was observed (level A according to a method of evaluation of fog (to be described later)), the image density was at least 1.5, and the dispersion of toner was not observed. The amount of conductive magnetic particles for charging mixed within the developing receptacle was 10% by weight making the total weight of magnetic carrier particles for development present within the developing receptacle a reference.

Fog was obtained in the following method. That is, the reflection density of a fog portion on the transfer paper and the reflection density of the transfer paper before image formation were measured by a densitometer TC-6DS made by Tokyo Denshoku, Co., Ltd., and the fog density was calculated according to the following equation (3):

fog density (%)=(the reflection density of the fog portion on the transfer paper−(the reflection density of the transfer paper) - - - (equation 3).

Evaluation Standards level A: fog density<0.5: substantially no fog level B: 0.5≦fog density<1: little fog level C: 1≦fog density<2: a little fog level D: 2≦fog density<3: fog present level E: 3≦fog density: a considerable fog As for the image density, the reflection density of the image on the transfer paper was measured using a densitometer Type 941 made by X-rite Corp.

EXAMPLE 2

Image formation was performed under the following charging conditions, developing conditions and charging series using the following a-Si photosensitive member for positive charging, the magnetic-brush charger shown in FIG. 3, and the developing device according to the two-component-type contact developing method shown in FIGS. 2A and 2B in the image forming apparatus shown in FIG. 1, and fog and the dispersion of toner on a transfer sheet were evaluated.

Photosensitive Member:

the volume resistivity of the surface layer of the photosensitive member - - - $1\times10^{-14}$ Ω·cm Charging Conditions:

the materials of conductive magnetic particles - - - core; ferrite, coating material; a fluorine-type resin the volume resistivity of the conductive magnetic particles - - - $1\times10^{6}$ Ω·cm the average diameter of the conductive magnetic particles - - - 30 μm the saturation magnetization of the conductive magnetic particles - - - 200 emu/cm$^3$ (in a magnetic field of 1 kOe)

the outer diameter of the charging sleeve - - - 16 mm the rotational speed of the charging sleeve - - - 280 rpm (in a direction opposite to the moving direction of the surface of the photosensitive member)

the magnetic poles of the magnet within the charging sleeve - - - 4 poles shown in FIG. 3 the DC component of the charging bias voltage - - - +650 V the AC component of the charging bias voltage - - - 700 Vpp, 1,000 Hz the surface potential of the charged photosensitive member - - - +650 V Developing conditions:

developer - - - a two-component-type developer (a toner density of 6 weight %) including a nonmagnetic toner having a negative charging property including a styrene/acrylic-type resin as a main component and a coloring agent and a negative-charge controlling agent, and magnetic-material-dispersion-type resin carrier particles obtained by coating the surfaces of magnetic-material-dispersion-type carrier cores obtained by dispersing magnetite and hematite in a phenol resin with a silicone resin the volume resistivity of the magnetic carrier particles - - - $1\times10^{10}$ Ω·cm the average diameter of the magnetic carrier particles - - - 35 μm the saturation magnetization of the magnetic carrier particles - - - 100 emu/cm$^3$ (in a magnetic field of 1 kOe)

the outer diameter of the developing sleeve - - - 32 mm the rotational speed of the developing sleeve - - - 300 rpm (in the moving direction of the surface of the photosensitive member)

the magnetic poles of the magnet within the developing sleeve - - - 5 poles shown in FIG. 2A the DC component of the developing bias voltage - - - +500 V the AC component of the developing bias voltage - - - 2,000 Vpp, 2,000 Hz the light-portion potential - - - +200 V the shortest interval between the surface of the developing sleeve and the surface of the photosensitive member - - - 500 μm the shortest interval between the surface of the the developing sleeve and the surface of the blade - - - 800 μm Charging series (the amount of frictional charging of toner): All of the conductive magnetic particles, the magnetic carrier particles and toner were initial materials. Measurement was performed under an environment of 23° C./50% RH according to a two-component blow-off method.

the amount of frictional charging of the toner with respect to the conductive magnetic particles for charging - - - −22 mC/kg the amount of frictional charging of the toner with respect to the carrier particles for development - - - −20 mC/kg Image formation was performed under the above-described conditions. Even after repeating image forming operations for 50,000 sheets, an excellent image was obtained in which little fog was observed (level B according to the above-described method of evaluation), the image density was at least 1.5, and the dispersion of toner was little observed. The amount of conductive magnetic particles for charging mixed within the developing receptacle was 14% by weight making the total weight of magnetic carrier particles for development present within the developing receptacle a reference.

EXAMPLE 3

Evaluation was performed in the same manner as in Example 1, except that the conductive magnetic particles of the magnetic-brush charger and the magnetic carrier particles for development of the two-component-type developer used in Example 1 were replaced by the following particles.

(Conductive magnetic particles)

the materials of conductive magnetic particles - - - core; ferrite, coating material; an acrylic-type resin the volume resistivity of the conductive magnetic particles - - - $1\times10^{6}$ Ω·cm the average diameter of the conductive magnetic particles - - - 30 μm the saturation magnetization of the conductive magnetic particles - - - 200 emu/cm$^3$ (in a magnetic field of 1 kOe)

(Magnetic carrier particles)

the material of magnetic carrier particles - - - magnetic-material-dispersion-type resin carrier particles obtained by coating the surfaces of magnetic-material-dispersion-type carrier cores obtained by dispersing magnetite and hematite in a phenol resin with a silicone resin the volume resistivity of the magnetic carrier particles - - - $1\times10^{10}$ Ω·cm the average diameter of the magnetic carrier particles - - - 40 μm the saturation magnetization of the magnetic carrier particles - - - 300 emu/cm$^3$ (in a magnetic field of 1 kOe)

The amounts of frictional charging of the toner with respect to the above-described conductive magnetic particles for charging and magnetic carrier particles for development are as follows.

Charging series (the amount of frictional charging of toner): All of the conductive magnetic particles, the magnetic carrier particles and toner were initial materials. Measurement was performed under an environment of 23° C./50% RH according to a two-component blow-off method.

the amount of frictional charging of the toner with respect to the conductive magnetic particles for charging - - - −27 mC/kg the amount of frictional charging of the toner with respect to the carrier particles for development - - - −20 mC/kg Image formation was performed under the above-described conditions. Even after repeating image forming operations for 50,000 sheets, an excellent image having no practical problem was obtained in which a little fog was observed (level C according to the above-described method of evaluation), the image density was at least 1.5, and the dispersion of toner caused no practical problem. The amount of conductive magnetic particles for charging mixed within the developing receptacle was 15% by weight making the total weight of magnetic carrier particles for development present within the developing receptacle a reference.

COMPARATIVE EXAMPLE 1

Evaluation was performed in the same manner as in Example 1, except that the conductive magnetic particles of the magnetic-brush charger and the magnetic carrier particles for development of the two-component-type developer used in Example 1 were replaced by the following particles.

(Conductive magnetic particles)

the materials of conductive magnetic particles - - - core; ferrite, coating material; a silicone-type resin the volume resistivity of the conductive magnetic particles - - - $1\times10^{6}$ Ω·cm the volume average diameter of the conductive magnetic particles - - - 22 μm the saturation magnetization of the conductive magnetic particles - - - 200 emu/cm$^3$ (in a magnetic field of 1 kOe)

(Magnetic carrier particles)

the material of magnetic carrier particles - - - magnetic-material-dispersion-type resin carrier particles obtained by coating the surfaces of magnetic-material-dispersion-type carrier cores obtained by dispersing magnetite and hematite in a phenol resin with an acrylic-type resin the volume resistivity of the magnetic carrier particles - - - $1\times10^{10}$ Ω·cm the average diameter of the magnetic carrier particles - - - 33 μm the saturation magnetization of the magnetic carrier particles - - - 140 emu/cm$^3$ (in a magnetic field of 1 kOe)

The amounts of frictional charging of the toner with respect to the above-described conductive magnetic particles for charging and magnetic carrier particles for development are as follows.

Charging series (the amount of frictional charging of toner): All of the conductive magnetic particles, the magnetic carrier particles and toner were initial materials. Measurement was performed under an environment of 23° C./50% RH according to a two-component blow-off method.

the amount of frictional charging of the toner with respect to the conductive magnetic particles for charging - - - −16 mC/kg the amount of frictional charging of the toner with respect to the carrier particles for development - - - −27 mC/kg Image formation was performed under the above-described conditions. After repeating image forming operations for 20,000 sheets, fog was observed in the obtained image (level D according to the above-described method of evaluation), the maximum image density was only 1.3, and the dispersion of toner increased, and defects were generated in the image. The amount of conductive magnetic particles for charging mixed within the developing receptacle after forming images on 20,000 sheets was 18% by weight making the total weight of magnetic carrier particles for development present within the developing receptacle a reference.

EXAMPLE 4

Evaluation was performed in the same manner as in Example 1, except that the outer diameter of the charging sleeve of the magnetic-brush charger was changed to 12 mm, and the rotational speed of the charging sleeve was changed to 278 rpm (in a direction opposite to the moving direction of the surface of the photosensitive member).

Image formation was performed under the above-described conditions. After repeating image forming operations for 50,000 sheets, although a little fog was observed (level C according to the above-described method of evaluation), the image density was at least 1.5, and an excellent image having no practical problem with respect to the dispersion of toner was obtained. The amount of conductive magnetic particles for charging mixed within the developing receptacle after forming images on 50,000 sheets was 19% by weight making the total weight of magnetic carrier particles for development present within the developing receptacle a reference.

COMPARATIVE EXAMPLE 2

Evaluation was performed in the same manner as in Example 4, except that the conductive magnetic particles of the magnetic-brush charger and the magnetic carrier particles for development of the two-component-type developer used in Example 4 were replaced by the following particles.

(Conductive magnetic particles)

the materials of conductive magnetic particles - - - After pulverizing 10 parts of MgO, 10 parts of MnO, and 80 parts of $Fe_2O_3$, the obtained particles were mixed by adding water, to provide particles. The obtained particles were coated with 51 parts of a coating material made of vinylidene fluoride/methyl methacrylate in which 2 parts of carbon black was dispersed.

the volume resistivity of the conductive magnetic particles - - - $1\times10^{6}$ Ω·cm the average diameter of the conductive magnetic particles - - - 28.5 μm the saturation magnetization of the conductive magnetic particles - - - 150 emu/cm$^3$ (in a magnetic field of 1 kOe)

(Magnetic carrier particles)

the material of magnetic carrier particles - - - the same as in Example 3 the volume resistivity of the magnetic carrier particles - - - $4\times10^{12}$ Ω·cm the average diameter of the magnetic carrier particles - - - 33 μm the saturation magnetization of the magnetic carrier particles - - - 137 emu/cm$^3$ (in a magnetic field of 1 kOe)

The amounts of frictional charging of the toner with respect to the above-described conductive magnetic particles for charging and magnetic carrier particles for development are as follows.

Charging series (the amount of frictional charging of toner): All of the conductive magnetic particles, the magnetic carrier particles and toner were initial materials. Measurement was performed under an environment of 23° C./50% RH according to a two-component blow-off method.

the amount of frictional charging of the toner with respect to the conductive magnetic particles for charging - - - −16 mC/kg the amount of frictional charging of the toner with respect to the carrier particles for development - - - −27 mC/kg Image formation was performed under the above-described conditions. After repeating image forming operations for 50,000 sheets, fog was observed (level D according to the above-described method of evaluation), the maximum image density was only 1.3, the dispersion of toner increased, and defects were generated in the obtained image. The amount of conductive magnetic particles for charging mixed within the developing receptacle after forming images on 50,000 sheets was 18 weight % making the total weight of magnetic carrier particles for development present within the developing receptacle a reference.

EXAMPLE 5

Evaluation was performed in the same manner as in Example 1, except that the image forming apparatus of the cleaner-less method, which does no include a cleaner, shown in FIG. 6 was used instead of the image forming apparatus shown in FIG. 1 used in Example 1, and that after first receiving toner particles remaining after image transfer present on the photosensitive member into the magnetic brush of the magnetic-brush charger, the toner particles were discharged from the magnetic brush onto the photosensitive member, and were collected into the developing receptacle at the developing region in accordance with the movement of the photosensitive member.

Image formation was performed under the above-described conditions. Even after repeating image forming operations for 50,000 sheets, an excellent image was obtained in which no fog was observed (level A according to the above-described method of evaluation), the image density was at least 1.5, and the dispersion of toner was not observed. The amount of conductive magnetic particles for charging mixed within the developing receptacle after forming images on 50,000 sheets was 10 weight % making the total weight of magnetic carrier particles for development present within the developing receptacle a reference.

The efficiency of toner consumption when forming 50,000 images having an image area ratio of 50% on A4-size recording materials was improved by 20% than in the image forming apparatus in Example 1.

EXAMPLE 6

Evaluation of fog in the obtained image, the image density, and the dispersion of toner was performed in the same manner as in Example 1 by repeating image forming operations for 50,000 sheets under the following charging conditions, developing conditions, physical properties of conductive magnetic particles for charging, and physical properties of magnetic carrier particles for development using the OPC photosensitive member having the charge injection layer shown in FIG. 5, the magnetic-brush charger shown in FIG. 3, and the developing device according to the two-component-type contact developing method shown in FIGS. 2A and 2B in the image forming apparatus shown in FIG. 1.

Charging conditions:

the materials of conductive magnetic particles - - - core; ferrite (280 emu/cm$^3$), coating material; a silicone-type resin the volume resistivity of the conductive magnetic particles - - - $1\times10^7$ Ω·cm the average diameter of the conductive magnetic particles - - - 28 μm the saturation magnetization of the conductive magnetic particles - - - 200 emu/cm$^3$ (in a magnetic field of 1 kOe)

the outer diameter of the charging sleeve - - - 16 mm the rotational speed of the charging sleeve - - - 168 rpm (in a direction opposite to the moving direction of the surface of the photosensitive member)

the magnetic poles of the magnet within the charging sleeve - - - 4 poles shown in FIG. 3 the DC component of the charging bias voltage - - - −650 V the AC component of the charging bias voltage - - - 700 Vpp, 1,000 Hz Developing conditions:

Developer developing toner - - - a non-magnetic toner including a polyester resin as a main component and a coloring agent and a negative-charge controlling agent magnetic carrier particles for development - - - core; ferrite (280 emu/cm$^3$) coating material; asilicone-type resin (the same material as the coating material for the conductive magnetic particles for charging)

the volume resistivity of the magnetic carrier particles - - - $1\times10^7$ Ω·cm the volume average diameter of the magnetic carrier particles - - - 28 μm the saturation magnetization of the magnetic carrier particles - - - 140 emu/cm$^3$ (in a magnetic field of 1 kOe)

Mixing ratio - - - the density of the toner in the developer - - - 8% the outer diameter of the developing sleeve - - - 16 mm the rotational speed of the developing sleeve - - - 210 rpm (in the moving direction of the surface of the photosensitive member)

the magnetic poles of the magnet within the developing sleeve - - - 5 poles shown in FIG. 2A the DC component of the developing bias voltage - - - −500 V the AC component of the developing bias voltage - - - 2,000 Vpp, 2,000 Hz the shortest interval between the surface of the developing sleeve and the surface of the photosensitive member - - - 500 μm the shortest interval between the surface of the the developing sleeve and the surface of the blade - - - 600 μm (Surface potential of the photosensitive member)

the potential of the image portion (a light-portion potential) - - - −200 V the potential of the non-image portion (a dark-portion potential) - - - −650 V (the amount of frictional charging of the toner)

the amount of frictional charging of the toner with respect to the conductive magnetic particles for charging - - - −22 mC/kg the amount of frictional charging of the toner with respect to the carrier particles for development - - - −22 mC/kg All of the conductive magnetic particles, the magnetic carrier particles and toner were initial materials. Measurement was performed under an environment of 23° C./50% RH according to a two-component blow-off method.

Image formation was performed under the above-described conditions. Even after repeating image forming operations for 50,000 sheets, an excellent image was obtained in which no fog was observed (level A according to the above-described method of evaluation), the image density was at least 1.5, and the dispersion of toner was not observed. The amount of conductive magnetic particles for charging mixed within the developing receptacle after image formation on 50,000 sheets was 10% by weight making the total weight of magnetic carrier particles for development present within the developing receptacle a reference.

EXAMPLE 7

Image formation operations for 50,000 sheets were repeated under the following conditions using the following a-Si photosensitive member having a positive charging property, the magnetic-brush charger shown in FIG. 3, and the developing device according to the two-component-type contact developing method shown in FIGS. 2A and 2B in the image forming apparatus shown in FIG. 1, and fog, the image density, and the dispersion of toner on a transfer sheet were evaluated in the same manner as in Example 6. The evaluation was performed in the same manner as in Example 6.

Photosensitive member:

the volume resistivity of the surface layer of the photosensitive member - - - $1\times10^{14}$ Ω·cm Charging conditions:

the materials of conductive magnetic particles - - - core; ferrite 280 emu/cm$^3$), coating material; a fluorine-type resin the volume resistivity of the conductive magnetic particles - - - $1\times10^{7}$ Ω·cm the volume average diameter of the conductive magnetic particles - - - 22 μm the saturation magnetization of the conductive magnetic particles - - - 200 emu/cm$^3$ (in a magnetic field of 1 kOe)

the outer diameter of the charging sleeve - - - 16 mm the rotation speed of the charging sleeve - - - 150 rpm (in a direction opposite to the moving direction of the surface of the photosensitive member)

the magnetic poles of the magnet within the charging sleeve - - - 4 poles shown in FIG. 3 the DC component of the charging bias voltage - - - +650 V the AC component of the charging bias voltage - - - 700 Vpp, 1,000 Hz Developing conditions:

Developer developing toner - - - a non-magnetic toner including a styrene/acrylic-type resin as a main component and a coloring agent and a negative-charge controlling agent magnetic carrier particles for development - - - core; magnetic-material-dispersion-type polymerized magnetic particles (200 emu/cm$^3$) coating material; a fluorine-type resin (the same material as the coating material for the conductive magnetic particles for charging)

the volume resistivity of the magnetic carrier particles - - - $1\times10^{9}$ Ω·cm the average diameter of the magnetic carrier particles - - - 28 μm the saturation magnetization of the magnetic carrier particles - - - 210 emu/cm$^3$ (in a magnetic field of 1 kOe)

Mixing ratio - - - the density of the toner in the developer - - - 7% the outer diameter of the developing sleeve - - - 32 mm the rotational speed of the developing sleeve - - - 210 rpm (in the moving direction of the surface of the photosensitive member)

the magnetic poles of the magnet within the developing sleeve - - - 5 poles shown in FIG. 2A the DC component of the developing bias voltage - - - +500 V the AC component of the developing bias voltage - - - 2,000 Vpp, 2,000 Hz the shortest interval between the surface of the developing sleeve and the surface of the photosensitive member - - - 500 μm the shortest interval between the surface of the the developing sleeve and the surface of the blade - - - 600 μm (Surface potential of the photosensitive member)

the potential of the image portion (light-portion potential) - - - +200 V the potential of the non-image portion (dark-portion potential) - - - +650 V (The amount of frictional charging of the toner)

the amount of frictional charging of the toner with respect to the conductive magnetic particles for charging - - - +27 mC/kg the amount of frictional charging of the toner with respect to the carrier particles for development - - - +25 mC/kg Image formation was performed under the above-described conditions. Even after repeating image forming operations for 50,000 sheets, an excellent image was obtained in which little fog was observed (level B according to the above-described method of evaluation), the image density was at least 1.5, and the dispersion of toner was little observed. The amount of conductive magnetic particles for charging mixed within the developing receptacle after image formation on 50,000 sheets was 14% by weight making the total weight of magnetic carrier particles for development present within the developing receptacle a reference.

COMPARATIVE EXAMPLE 3

Evaluation was performed in the same manner as in Example 6, except that the conductive magnetic particles of the magnetic-brush charger and the magnetic carrier particles for development of the two-component-type developer used in Example 1 were replaced by the following particles.

(Conductive magnetic particles for charging)

the materials of conductive magnetic particles - - - core; ferrite, coating material; a titanium coupling agent the volume resistivity of the conductive magnetic particles - - - $1\times10^6$ Ω·cm the volume average diameter of the conductive magnetic particles - - - 22 μm the saturation magnetization of the conductive magnetic particles - - - 280 emu/cm$^3$ (in a magnetic field of 1 kOe)

(Magnetic carrier particles for development)

the material of magnetic carrier particles - - - core; magnetic-material-dispersion-type polymerized magnetic particles obtained by dispersing magnetite and hematite in a phenol resin, coating material; a silicone-type resin the volume resistivity of the magnetic carrier particles - - - 1×10 Ω·cm the average diameter of the magnetic carrier particles - - - 35 μm the saturation magnetization of the magnetic carrier particles - - - 180 emu/cm$^3$ (in a magnetic field of 1 kOe)

The amounts of frictional charging of the toner with respect to the above-described conductive magnetic particles for charging and magnetic carrier particles for development are as follows.

(The amount of frictional charging of toner)

the amount of frictional charging of the toner with respect to the conductive magnetic particles for charging - - - −16 mC/kg the amount of frictional charging of the toner with respect to the carrier particles for development - - - −28 mC/kg Image formation was performed under the above-described conditions. After repeating image forming operations for 20,000 sheets, fog was observed in the obtained image (level D according to the above-described method of evaluation), the maximum image density was only 1.3, and the dispersion of toner increased, and defects were generated in the obtained image. The amount of conductive magnetic particles for charging mixed within the developing receptacle after forming images on 20,000 sheets was 25% by weight making the total weight of magnetic carrier particles for development present within the developing receptacle a reference.

The individual components shown in outline or designated by blocks in the drawings are all well known in the image forming method and apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming method comprising:

a charging step of using a charging device including conductive magnetic particles, a rotatable conductive-magnetic-particle carrying member for carrying and conveying the conductive magnetic particles, and a plurality of magnetic-field generation means provided within the conductive-magnetic-particle carrying member, and charging a surface of an image bearing member by applying a voltage to the conductive-magnetic-particle carrying member and causing the conductive magnetic particles to contact the image bearing member;

a latent-image forming step of forming an electrostatic latent image on the charged surface of the image bearing member; and a developing step of using a developing device facing the image bearing member and including a two-component developer including a toner and magnetic carrier particles, a developer carrying member for carrying the two-component developer, and a plurality of magnetic-field generation means provided within the developer carrying member, and forming a toner image by forming an electric field at a portion where the image bearing member faces the developer carrying member and developing the electrostatic latent image by the toner of the two-component developer, wherein an amount of frictional charging ($Q_1$) of the toner with the conductive magnetic particles and an amount of frictional charging ($Q_2$) of the toner with the magnetic carrier particles within the developing device satisfy the following relationship:

$$0<Q_2\leqq Q_1 \text{ (mC/kg), or } 0>Q_2\geqq Q_1 \text{ (mC/kg).}$$

2. A method according to claim 1, wherein the conductive-magnetic-particle carrying member has the shape of a cylinder having an outer diameter equal to or less than 25 mm, and rotates at a rotational speed within a range of 70–400 rpm in said charging step.

3. A method according to claim 1, wherein the conductive-magnetic-particle carrying member has the shape of a cylinder having an outer diameter within a range of 10–20 mm, and rotates at a rotational speed within a range of 140–280 rpm in said charging step.

4. A method according to claim 1, wherein the amount of frictional charging ($Q_1$) of the toner with respect to the conductive magnetic particles and the amount of frictional charging ($Q_2$) of the toner with respect to the magnetic carrier particles within the developing device satisfy the following relatonship:

$$0<Q_2<Q_1 \text{ (mC/kg), or } 0>Q_2>Q_1 \text{ (mC/kg).}$$

5. A method according to claim 1, wherein the amount of frictional charging ($Q_1$) of the toner with respect to the conductive magnetic particles and the amount of frictional charging ($Q_2$) of the toner with respect to the magnetic carrier particles within the developing device satisfy the following relationship:

$$5\leqq|Q_1|\leqq 60 \text{ (mC/kg), and } 5\leqq|Q_2\leqq 60 \text{ (mC/kg).}$$

6. A method according to claim 1, wherein the developer carrying member has the shape of a cylinder having an outer diameter equal to or less than 35 mm.

7. A method according to claim 1, wherein the developer carrying member has the shape of a cylinder having an outer diameter within a range of 10–25 mm.

8. A method according to claim 1, wherein the developing device includes a developing receptacle for holding the two-component-type developer, and wherein an amount of the conductive magnetic particles mixed in the developing receptacle is equal to or less than 20 weight % with respect to a weight of the magnetic carrier particles held within the developing receptacle.

9. A method according to claim 1, wherein the developing device includes a developing receptacle for holding the two-component-type developer, and wherein an amount of the conductive magnetic particles mixed in the developing receptacle is equal to or less than 20 weight % with respect to a weight of the magnetic carrier particles held within the developing receptacle, and wherein the amount of frictional charging ($Q_1$) of the toner with respect to the conductive magnetic particles and the amount of frictional charging ($Q_2$) of the toner with respect to the magnetic carrier particles within the developing device satisfy the following relationship:

$$0<Q_1<Q_1 \text{ (mC/kg), or } 0>Q_2>Q_1 \text{ (mC/kg).}$$

10. A method according to claim 1, wherein the developing device includes a developing receptacle for holding the two-component-type developer, and wherein an amount of the conductive magnetic particles mixed in the developing receptacle is equal to or less than 20 weight % with respect to a weight of the magnetic carrier particles held within the developing receptacle, and wherein the amount of frictional charging ($Q_1$) of the toner with respect to the conductive magnetic particles and the amount of frictional charging ($Q_2$) of the toner with respect to the magnetic carrier particles within the developing device satisfy the following relationship:

$$5\leqq|Q_1|<60 \text{ (mC/kg), and } 5\leqq|Q_2|<60 \text{ (mC/kg).}$$

11. A method according to claim 1, wherein the conductive magnetic particles for charging have a volume resistivity within a range of $10^2$–$10^{10}$ Ω·cm.

12. A method according to claim 1, wherein the conductive magnetic particles for charging have a volume resistivity within a range of $10^6$–$10^{10}$ Ω·cm.

13. A method according to claim 1, wherein the conductive magnetic particles for charging have an average diameter within a range of 5–80 μm.

14. A method according to claim 1, wherein the conductive magnetic particles for charging have a volume average diameter within a range of 10–60 μm.

15. A method according to claim 1, wherein the conductive magnetic particle for charging includes a magnetic core particle comprising a resin magnetic particle formed by polymerizing a binder resin, a magnetic metal oxide, and a nonmagnetic metal oxide.

16. A method according to claim 1, wherein the voltage applied to the conductive-magnetic-particle carrying member in said charging step is a DC voltage on which an AC voltage is superposed.

17. A method according to claim 1, wherein the magnetic carrier particles for development have a volume resistivity within a range between $10^6$–$10^{12}$ Ω·cm.

18. A method according to claim 1, wherein the magnetic carrier particles for development have an average diameter within a range of 10–60 μm.

19. A method according to claim 1, wherein the magnetic carrier particles for development have a volume average diameter within a range 20–60 μm.

20. A method according to claim 1, wherein the magnetic carrier particle for development includes a carrier core particle comprising a resin magnetic particle formed by polymerizing a binder resin, a magnetic metal oxide, and a nonmagnetic metal oxide.

21. A method according to claim 1, wherein the voltage applied to the developer carrying member in said developing step is a DC voltage on which an AC voltage is superposed.

22. A method according to claim 1, wherein the surfaces of the conductive magnetic particles for charging and the surfaces of the magnetic carrier particles for development are coated with the same material.

23. A method according to claim 22, wherein the conductive magnetic particles for charging and the magnetic carrier particles for development have a volume resistivity within a range of $10^5$–$10^{12}$ Ω·cm.

24. A method according to claim 22, wherein the conductive magnetic particles for charging and the magnetic carrier particles for development have a volume resistivity within a range of $10^6$–$10^9$ Ω·cm.

25. A method according to claim 22, wherein the conductive magnetic particles for charging and the magnetic carrier particles for development have an amount of magnetization within a range of 50–350 emu/cm$^3$ in a magnetic field of 1 kOe.

26. A method according to claim 22, wherein the conductive magnetic particles for charging and the magnetic carrier particles for development have an amount of magnetization within a range of 70–350 emu/cm$^3$ in a magnetic field of 1 kOe.

27. A method according to claim 22, wherein the conductive magnetic particles for charging and the magnetic carrier particles for development have an average volume diameter within a range of 5–80 μm.

28. A method according to claim 22, wherein the conductive magnetic particles for charging and the magnetic carrier particles for development have an average volume diameter within a range of 10–60 μm.

29. A method according to claim 22, wherein the conductive magnetic particle for charging includes a magnetic core particle comprising a resin magnetic particle formed by polymerizing a binder resin, a magnetic metal oxide, and a nonmagnetic metal oxide.

30. A method according to claim 22, wherein the voltage applied to the conductive-magnetic-particle carrying member in said charging step is a DC voltage on which an AC voltage is superposed.

31. A method according to claim 22, wherein the magnetic carrier particle for development includes a carrier core particle comprising a resin magnetic particle formed by polymerizing a binder resin, a magnetic metal oxide, and a nonmagnetic metal oxide.

32. A method according to claim 22, wherein the voltage applied to the developer carrying member in said developing step is a DC voltage on which an AC voltage is superposed.

33. A method according to claim 1, wherein the image bearing member includes a surface layer having a volume resistivity within a range of $10^6$–$10^{14}$ Ω·cm.

34. A method according to claim 33, wherein the image bearing member includes an organic photoconductor (OPC) photosensitive member.

35. A method according to claim 33, wherein the image bearing member includes an amorphous silicon (a-Si) photosensitive member.

36. A method according to claim 1, further comprising:

a transfer step of transferring the toner image formed on the image bearing member onto a transfer material, wherein a cleaning step of removing toner particles remaining on the image bearing member after said transfer step from the surface of the image bearing member is not provided after said transfer step and before said charging step, and the toner particles remaining on the image bearing member after said transfer step are collected in the developing device.

37. An image forming apparatus comprising:

a latent-image bearing member for bearing an electrostatic latent image;

a charging device, comprising conductive magnetic particles, a rotatable conductive-magnetic-particle carrying member for carrying and conveying the conductive magnetic particles, and a plurality of magnetic-field generation means provided within the conductive-magnetic-particle carrying member, for charging said latent-image bearing member, said charging device charging a surface of said latent-image bearing member by applying a voltage to the conductive-magnetic-particle carrying member and causing the conductive magnetic particles to contact said latent-image bearing member;

latent-image forming means for forming the electrostatic latent image on the charged surface of said latent-image bearing member; and a developing device, facing said latent-image bearing member and comprising a two-component developer comprising a toner and magnetic carrier particles, a developer carrying member for carrying the two-component developer, and a plurality of magnetic-field generation means provided within the developer carrying member, for forming a toner image by developing the electrostatic latent image, said developing device forming an electric field at a portion where said latent-image bearing member faces the developer carrying member and developing the electrostatic latent image by the toner of the two-component developer, wherein an amount of frictional charging ($Q_1$) of the toner with the conductive magnetic particles and an amount of frictional charging ($Q_2$) of the toner with the magnetic carrier particles within said developing device satisfy the following relationship:

$$0<Q_2\leqq Q_1 \text{ (mC/kg), or } 0>Q_2\geqq Q_1 \text{ (mC/kg).}$$

38. An apparatus according to claim 37, wherein the conductive-magnetic-particle carrying member has the shape of a cylinder having an outer diameter equal to or less than 25 mm, and rotates at a rotational speed within a range of 70–400 rpm during charging.

39. An apparatus according to claim 37, wherein the conductive-magnetic-particle carrying member has the shape of a cylinder having an outer diameter within a range of 10–20 mm, and rotates at a rotational speed within a range of 140–280 rpm during charging.

40. An apparatus according to claim 37, wherein the amount of frictional charging ($Q_1$) of the toner with respect to the conductive magnetic particles and the amount of frictional charging ($Q_1$) of the toner with respect to the magnetic carrier particles within said developing device satisfy the following relationship:

$$0<Q_2<Q_1 \text{ (mC/kg) or } 0>Q_2>Q_1 \text{ (mC/kg).}$$

41. An apparatus according to claim 37, wherein the amount of frictional charging ($Q_1$) of the toner with respect to the conductive magnetic particles and the amount of frictional charging ($Q_2$) of the toner with respect to the magnetic carrier particles within said developing device satisfy the following relationship:

$$5\leqq|Q_1|\leqq 60 \text{ (mC/kg), and } 5\leqq|Q_2|\leqq 60 \text{ (mC/kg).}$$

42. An apparatus according to claim 37, wherein the developer carrying member has the shape of a cylinder having an outer diameter equal to or less than 35 mm.

43. An apparatus according to claim 37, wherein the developer carrying member has the shape of a cylinder having an outer diameter within a range of 10–25 mm.

44. An apparatus according to claim 37, wherein said developing device comprises a developing receptacle for holding the two-component-type developer, and wherein an amount of the conductive magnetic particles mixed in said developing receptacle is equal to or less than 20 weight % with respect to a weight of the magnetic carrier particles held within said developing receptacle.

45. An apparatus according to claim 37, wherein said developing device comprises a developing receptacle for holding the two-component-type developer, and wherein an amount of the conductive magnetic particles mixed in said developing receptacle is equal to or less than 20 weight % with respect to a weight of the magnetic carrier particles held within said developing receptacle, and wherein the amount of frictional charging ($Q_1$) of the toner with respect to the conductive magnetic particles and the amount of frictional charging ($Q_2$) of the toner with respect to the magnetic carrier particles within said developing device satisfy the following relationship:

$$0<Q_2<Q_1 \text{ (mC/kg) or } 0>Q_2>Q_1 \text{ (mC/kg).}$$

46. An apparatus according to claim 37, wherein said developing device comprises a developing receptacle for holding the two-component-type developer, and wherein an amount of the conductive magnetic particles mixed in said developing receptacle is equal to or less than 20 weight % with respect to a weight of the magnetic carrier particles held within said developing receptacle, and wherein the amount of frictional charging ($Q_1$) of the toner with respect to the conductive magnetic particles and the amount of frictional charging ($Q_2$) of the toner with respect to the magnetic carrier particles within said developing device satisfy the following relationship:

$$5\leqq|Q_1|\leqq 60 \text{ (mC/kg), and } 5\leqq|Q_2|\leqq 60 \text{ (mC/kg).}$$

47. An apparatus according to claim 37, wherein the conductive magnetic particles for charging have a volume resistivity within a range of $10^2$–$10^{10}$ Ω·cm.

48. An apparatus according to claim 37, wherein the conductive magnetic particles for charging have a volume resistivity within a range of $10^8$–$10^{10}$ Ω·cm.

49. An apparatus according to claim 37, wherein the conductive magnetic particles for charging have an average diameter within a range of 5–80 μm.

50. An apparatus according to claim 37, wherein the conductive magnetic particles for charging have an average diameter within a range of 10–60 μm.

51. An apparatus according to claim 37, wherein the conductive magnetic particle for charging includes a magnetic core particle comprising a resin magnetic particle formed by polymerizing a binder resin, a magnetic metal oxide, and a nonmagnetic metal oxide.

52. An apparatus according to claim 37, wherein the voltage applied to the conductive-magnetic-particle carrying member in said charging step is a DC voltage on which an AC voltage is superposed.

53. An apparatus according to claim 37, wherein the magnetic carrier particles for development have a volume resistivity within a range of $10^6$–$10^{12}$ Ω·cm.

54. An apparatus according to claim 37, wherein the magnetic carrier particles for development have an average diameter within a range of 10–60 μm.

55. An apparatus according to claim 37, wherein the magnetic carrier particles for development have an average diameter within a range of 20–60 μm.

56. An apparatus according to claim 37, wherein the magnetic carrier particle for development includes a carrier core particle comprising a resin magnetic particle formed by polymerizing a binder resin, a magnetic metal oxide, and a nonmagnetic metal oxide.

57. An apparatus according to claim 37, wherein the voltage applied to the developer carrying member in said developing step is a DC voltage on which an AC voltage is superposed.

58. An apparatus according to claim 37, wherein the surfaces of the conductive magnetic particles for charging and the surfaces of the magnetic carrier particles for development are coated with the same material.

59. An apparatus according to claim 58, wherein the conductive magnetic particles for charging and the magnetic carrier particles for development have a volume resistivity within a range of $10^5$–$10^{12}$ Ω·cm.

60. An apparatus according to claim 58, wherein the conductive magnetic particles for charging and the magnetic carrier particles for development have a volume resistivity within a range of $10^6$–$10^9$ Ω·cm.

61. An apparatus according to claim 58, wherein the conductive magnetic particles for charging and the magnetic carrier particles for development have an amount of magnetization within a range of 50–350 emu/cm$^3$ in a magnetic field of 1 kOe.

62. An apparatus according to claim 58, wherein the conductive magnetic particles for charging and the magnetic carrier particles for development have an amount of magnetization within a range of 70–350 emu/cm$^3$ in a magnetic field of 1 kOe.

63. An apparatus according to claim 58, wherein the conductive magnetic particles for charging and the magnetic carrier particles for development have an average volume diameter within a range of 5–80 μm.

64. An apparatus according to claim 58, wherein the conductive magnetic particles for charging and the magnetic carrier particles for development have an average volume diameter within a range of 10–60 μm.

65. An apparatus according to claim 58, wherein the conductive magnetic particle for charging includes a magnetic core particle comprising a resin magnetic particle formed by polymerizing a binder resin, a magnetic metal oxide, and a nonmagnetic metal oxide.

66. An apparatus according to claim 58, wherein the voltage applied to the conductive-magnetic-particle carrying member in said charging step is a DC voltage on which an AC voltage is superposed.

67. An apparatus according to claim 58, wherein the magnetic carrier particle for development includes a carrier core particle comprising a resin magnetic particle formed by polymerizing a binder resin, a magnetic metal oxide, and a nonmagnetic metal oxide.

68. An apparatus according to claim 58, wherein the voltage applied to the developer carrying member in said developing step is a DC voltage on which an AC voltage is superposed.

69. An apparatus according to claim 37, wherein said image bearing member comprises a surface layer having a volume resistivity within a range of $10^6$–$10^{14}$ Ω·cm.

70. An apparatus according to claim 69, wherein said image bearing member comprises an organic photoconductor (OPC) photosensitive member.

71. An apparatus according to claim 69, wherein said image bearing member comprises an amorphous silicon (a-Si) photosensitive member.

72. An apparatus according to claim 37, further comprising:

a transfer device for transferring the toner image formed on said image bearing member onto a transfer material, wherein a cleaning device for removing toner particles remaining on said image bearing member after image transfer from the surface of said image bearing member is not provided at a portion downstream from said transfer device and upstream from said charging device in a moving direction of said image bearing member, and the toner particles remaining on said image bearing member after image transfer are collected by said developing device.

* * * * *

UNITED STATES PATENT AND TRADEMARK OFFICE

CERTIFICATE OF CORRECTION

PATENT NO. : 6,294,305 B1
DATED : September 25, 2001
INVENTOR(S) : Yoshiaki Kobayashi et al.

It is certified that error appears in the above-identified patent and that said Letters Patent is hereby corrected as shown below:

Column 10,
Line 42, "are" should read -- is --.

Column 17,
Line 23, "cancel" should read -- cancellation --; and
Line 41, "polyearbonate" should read -- polycarbonate --.

Column 25,
Line 45, "no" should read -- not --.

Column 26,
Line 46, "asilicone-type" should read -- a silicone type --.

Column 31,
Line 21, "$0<Q_1<Q_1$" should read -- $0<Q_2<Q_1$ --; and
Line 67, "range" should read -- range of --.

Column 33,
Line 60, "$(Q_1)$" should read -- $(Q_2)$ --.

Signed and Sealed this

Sixteenth Day of April, 2002

*Attest:*

*Attesting Officer*

JAMES E. ROGAN
*Director of the United States Patent and Trademark Office*